US009217977B2

(12) United States Patent
Takahashi et al.

(10) Patent No.: US 9,217,977 B2
(45) Date of Patent: Dec. 22, 2015

(54) FINISHER, BOOKBINDER, AND IMAGING SYSTEM

(75) Inventors: Sei Takahashi, Minami-Alps (JP); Hideki Orii, Minami-Alps (JP); Naoki Ueda, Yamanashi (JP); Keiichi Nagasawa, Minami-Alps (JP); Kazuyuki Kubota, Minamikoma-gun (JP)

(73) Assignee: Nisca Corporation, Minamikoma-gun (JP)

( * ) Notice: Subject to any disclaimer, the term of this patent is extended or adjusted under 35 U.S.C. 154(b) by 547 days.

(21) Appl. No.: 12/328,787

(22) Filed: Dec. 5, 2008

(65) Prior Publication Data

US 2009/0148215 A1 Jun. 11, 2009

(30) Foreign Application Priority Data

Dec. 5, 2007 (JP) ..... 2007-314808

(51) Int. Cl.

| | |
|---|---|
| ***B42C 5/04*** | (2006.01) |
| ***G03G 15/00*** | (2006.01) |
| ***B26F 1/02*** | (2006.01) |
| ***B26F 1/12*** | (2006.01) |
| ***B42C 1/12*** | (2006.01) |
| ***B42C 11/04*** | (2006.01) |
| *B26D 1/08* | (2006.01) |
| *B26D 5/20* | (2006.01) |
| *B26D 5/26* | (2006.01) |
| *B26D 7/01* | (2006.01) |
| *B26D 7/32* | (2006.01) |
| *B26D 9/00* | (2006.01) |

(52) U.S. Cl.

CPC ..... *G03G 15/6541* (2013.01); *B26F 1/02* (2013.01); *B26F 1/12* (2013.01); *B42C 1/125* (2013.01); *B42C 5/04* (2013.01); *B42C 11/04* (2013.01); *B26D 1/08* (2013.01); *B26D 5/20* (2013.01); *B26D 5/26* (2013.01); *B26D 7/015* (2013.01); *B26D 7/32* (2013.01); *B26D 9/00* (2013.01); *G03G 2215/00936* (2013.01)

(58) Field of Classification Search

CPC ..... B26D 3/14; B26F 1/12; B23C 3/34; G03G 15/6541

USPC ..... 399/408; 412/6–8, 16, 33; 83/687, 691; 234/18, 19

IPC ..... B42C 5/04; B65H 33/02; B26D 3/14; B26F 1/12

See application file for complete search history.

(56) References Cited

U.S. PATENT DOCUMENTS 1,642,866 A * 9/1927 Ackley ..... 144/136.1
6,045,127 A * 4/2000 Fukui ..... 271/303

(Continued)

FOREIGN PATENT DOCUMENTS

JP 11035222 A * 2/1999 ..... B65H 37/04
JP 2007-062145 A 3/2007
JP 2007-276967 A 10/2007

*Primary Examiner* — Blake A Tankersley
*Assistant Examiner* — Ruben Parco, Jr.
(74) *Attorney, Agent, or Firm* — James W. Judge

(57) ABSTRACT

Single perforating unit is enabled to perforate for file binders and to cut milling grooves, while with a simple structure file-binder storage and booklet-binding can be carried out reliably. Configurations include: a convey-in path for sequentially transferring sheets; a stacker for collating into bundles sheets from the convey-in path; and an adhesive-layer applicator for adding an adhesive layer to the spine-closure edge of sheet bundles from the stacker. A perforating unit is provided in along the convey-in path, and a control unit for controlling position and/or number of perforations made by the perforating unit is provided with (1) a first operation mode in which it effects the punching of a predetermined number of holes in the edge of sheets, and (2) a second operation mode in which it effects the formation of a predetermined number of crenulated grooves in the edge of sheets.

18 Claims, 13 Drawing Sheets

(56) References Cited

U.S. PATENT DOCUMENTS

| | | | | |
|---|---|---|---|---|
| 6,120,015 | A * | 9/2000 | Albright et al. | 270/58.07 |
| 6,549,734 | B2 * | 4/2003 | Yamada et al. | 399/81 |
| 8,475,106 | B2 * | 7/2013 | Hata | 412/16 |
| 2002/0159877 | A1 * | 10/2002 | Chen | 414/791.2 |
| 2002/0168247 | A1 * | 11/2002 | Trovinger et al. | 412/1 |
| 2004/0118258 | A1 * | 6/2004 | Dera et al. | 83/39 |
| 2005/0110864 | A1 * | 5/2005 | Kan et al. | 347/264 |
| 2005/0265765 | A1 * | 12/2005 | Honmochi et al. | 399/408 |
| 2006/0210336 | A1 * | 9/2006 | Horiguchi et al. | 399/405 |
| 2007/0045928 | A1 * | 3/2007 | Yoshie et al. | 270/58.08 |

* cited by examiner

FINISHER, BOOKBINDER, AND IMAGING SYSTEM

BACKGROUND OF THE INVENTION

1. Technical Field

The present invention—involving finishing and bookbinding devices for collating and stacking, as well as binding into booklets, sheets onto which images have been formed by an imaging device—relates to improvements in mechanisms for perforating sheets with binder holes, and collating and stacking the sheets, as well as binding them into booklets.

2. Description of the Related Art

Widely known among finishing devices (finishers) as well as bookbinding devices (bookbinders) of this type are in general devices that sequentially stow into a storage stacker sheets fed from a printer, scanner, or like imaging device, as well as devices that collate sheets into bundles and bind them into booklets. With the former—finishing devices—incorporating a built-in mechanism for punching holes into sheets, later provided to binders, in the course of the sheets being conveyed out is known. Meanwhile, in the latter—bookbinding devices—mechanisms for applying adhesive, or adding on adhesive tape, to the spine-portion endface of collated and stacked sheet bundles, and binding them together are known.

For example, Japanese Unexamined Pat. App. Pub. No. 2007-276967 (FIG. 1) proposes: a bookbinder in which sheets from an imaging device are collated and stacked, and adhesive is applied to the sheets and they are bound together with a coversheet; and a system apparatus wherein, in a finisher provided in association with the bookbinder, punch holes are perforated in sheets from the imaging device, and the sheets are stored in a storage stacker.

The device as cited above (JP 2007-276967) is a system in which the bookbinder, which is disposed at a downstream side of the imaging device, and the finisher, which is disposed at a downstream side thereof, are linked. In a bookbinding mode, the sheets fed to a carry-in path are bound in a booklet by the bookbinder while in a finishing mode, the sheets fed to the carry-in path are forwarded to the finisher, where holes are punched, seals or stamps are applied, and a jog segmentation is also done. The sheets are then stored in a storage stacker.

After that, the spine-portion endface of the sheet bundle collated and stacked in the bookbinder is applied adhesive (or an adhesive tape) so as to bind together the sheets. In this case, roughening the spine-portion endface of the sheet bundle in an uneven shape (milling process) is known. By roughening the spine endface, this process causes the adhesive to permeate, in order to prevent sheets from coming loose.

Examples of a mechanism include that proposed in FIG. 9 and FIG. 11 of Japanese Unexamined Pat. App. Pub. No. 2007-062145, which provides a saw-toothed punching blade in a transport path of the sheets and roughens the edge of the sheets with the punching blade, at the time of applying a milling process to the sheets sequentially fed from the imaging device. In the mechanism as cited above (JP 2007-062145), the sheets moved along the transport path are roughened by pushing a punching blade by a driving cam. The sheets are roughened one by one or several sheets are roughened by piling them on top of one another.

As mentioned above, it is well known that at the time of binding the sheets transported from an imaging device, etc., into a booklet, the roughened notched grooves are formed on the spine-closure edge, and the sheets are bound together by the adhesive, etc. In particular, in the patent reference cited earlier (JP 2007-062145), there is proposed the formation of the roughened punch holes in one or several pages of sheets at the stage prior to collating and stacking the sheets.

In the mechanism proposed in the patent reference (JP 2007-062145), the saw-toothed punching blade is moved up and down by using a clank arm. When milling grooves are formed on the spine-closure edge on the transport path of the sheets in this way, the mechanism becomes simplified and compact, providing an affordable milling process. However, in this type of conventionally known milling mechanism, the punching blade is saw-tooth shaped. Due to this shape, a punching blade in a round blade shape generally used for file binders, for example, cannot be diverted for this milling mechanism. This necessitates expensive manufacturing of the punching blade, and if some defects, such as a blade is chipped, develop in the blade during usage, the entire blade has to be replaced.

In the device or the system configuration in which the finishing function of punching holes for a binder is combined with the bookbinding function of punching holes for milling, as cited in the above patent reference (JP 2007-276967), a punch unit for file binders and that for milling have to be provided separately. This necessitates a large device, which increases a cost for the punch unit. As a result, its maintenance also becomes complicated, which are shortcomings.

BRIEF SUMMARY OF THE INVENTION

Therefore, the inventor has conceived the idea of selectively perforating for file binders and cutting milling grooves by the punching blade in a round blade shape.

A first object of the present invention is to provide a finisher capable of surely binding together sheets at the time of binding them into a booklet with a simple structure by perforating for file binders and cutting milling grooves by single perforating means, and also capable of providing binding holes at predetermined positions for file-binder situations.

A second object of the present invention is to provide a bookbinder capable of surely bonding the sheets by a lesser number of uneven grooves formed on the spine-closure edge at the time of binding the sheets into a booklet.

To attain the aforementioned objects, the present invention is configured to comprise perforating means for forming circular punch holes (round holes) in a transport path of sheets is arranged, and control means for controlling perforating positions and/or the number of holes by the perforating means. The control means includes (1) a first operation mode for perforating a predetermined number of punch holes on the edge of the sheet and (2) a second operation mode for perforating a predetermined number of uneven grooves on the edge of the sheet. Thereby, in the first operation mode, punch holes for a binder are perforated, and in the second operation mode, roughening grooves for binding a booklet are perforated. The main configurations will be explained below.

In one aspect, the present invention is equipped with: a convey-in path for sequentially moving sheets; stacking means for collating the sheets from the convey-in path into bundles; and adhesive-layer forming means for adding an adhesive layer to a spine-closure edge of the sheet bundle from the stacking means; and further equipped with: perforating means disposed between the convey-in path or the stacking means, and the adhesive-layer forming means, for forming circular punch holes at one or a plurality of locations on the sheet; control means arranged in the perforating means, for controlling a perforating position and/or the number of perforations; and the control means including a first operation mode for perforating punch holes for a binder on the end of the sheet and a second operation mode for perforating crenellated notch-holes on the edge of the sheet.

The perforating means is disposed along the convey-in path, the convey-in path is installed consecutively to a bookbinding process path and a sheet-discharge process path, which are separated from the convey-in path, and at a downstream side of the bookbinding process path, the stacking means is disposed, and at a downstream side of the sheet-discharge process path, a storage stacker for stacking and storing the sheets is disposed, respectively. The control means is configured to move a perforated sheet along the sheet-discharge process path in the first operation mode and move the perforated sheet along the bookbinding process path in the second operation mode.

In another aspect, the present invention is equipped with: a convey-in path for sequentially conveying sheets; stacking means for collating the sheets from the convey-in path into bundles; adhesive-layer forming means for adding an adhesive layer to a spine-closure edge of the sheet bundle from the stacking means; cover binding means for binding together the sheet bundle from the adhesive-layer forming means and a coversheet; and a cover feed path for feeding the coversheet to the cover binding means, and further equipped with perforating means disposed between the convey-in path or the stacking means, and the adhesive-layer forming means, for forming punch holes at one or a plurality of locations on the sheet; control means arranged in the perforating means, for controlling a perforating position and/or the number of perforations; and the control means including a first operation mode for perforating punch holes for a binder on the end of the sheet and a second operation mode for perforating crenellated notch-holes on the edge of the sheet.

The convey-in path is connected to an inner-leaf transport path along which the sheet is moved to the stacking means, and the cover feed path, which are separated from the convey-in path, and a storage stacker for stacking and storing the sheets is disposed at a downstream side of the cover feed path. In the first operation mode, the control means is so configured that punch holes are perforate on the ends of a coversheet and an inner leaf supplied to the convey-in path, and the sheets are moved from the cover feed path to the storage stacker, and in the second operation mode, the control means is so configured that crenellated notch-holes are perforated on the edge of the inner leaf fed to the convey-in path and the inner leaf is moved to the inner-leaf transport path.

At the time of moving the sheet from the convey-in path to the stacking means, the control means is so configured that sheets to be perforated and those not to be perforated in the second operation mode are selectively fed.

The perforating means and the sheet fed to a perforating position of the convey-in path are configured to move relative to a transport direction position, and the control means is configured to adjust the size of notch holes perforated on the edge of the sheet in the second operation mode, in the second operation mode.

Positioning means for setting the sheet to a predetermined perforating position is arranged along the convey-in path, the positioning means is configured by regulating means for regulating the end of the sheets by pushing against the sheets, and roller means for transporting the sheets from the regulating means by a predetermined amount, and the control means adjusts the size of the notch holes perforated on the edge of the sheets by a transport amount of the roller means, in the second operation mode.

The control means is configured to set large or small of the size of the notch holes perforated on the edge of the sheet based on sheet information such as a sheet material quality, a sheet size, a sheet basis weight (grammage), and the number of sheets to be collated, in the second operation mode.

The perforating means is equipped with a plurality of perforating cutters for simultaneously perforating a plurality of punch holes in a sheet width direction, the plurality of perforating cutters are so configured that the number of punch holes can be selected, and the control means is configured to select the number of crenellated notch-holes formed on the edge of the sheet in the second operation mode.

The control means is configured to select the number of the notch holes perforated on the edge of the sheet based on sheet information such as a sheet material quality, a sheet size, a sheet basis weight, and the number of sheets to be collated, in the second operation mode.

In the second operation mode, the control means is configured to selectively perforate the notch holes in the sheets moved to the inner-leaf transport path.

In the second operation mode, the control means perforates the notch holes perforated in at least one set of two successive sheets so that (1) the number of holes, and/or (2) the size of the holes, and/or (3) hole position are differed, when perforating the notch holes in the sheets moved to the inner-leaf transport path.

An imaging system according to the present invention is configured by: an imaging device for sequentially imaging on sheets; and a bookbinder for collating sheets from the imaging device into a bundle and wrapping the collated sheets with a coversheet to form a booklet. The bookbinder is equipped with the aforementioned configuration.

The present invention is that which is so configured that along the transport path for the sheets to be fed toward the adhesive-layer forming (applying) means for binding sheets into a booklet, the perforating means for forming the circular punch holes is arranged, and the control means for controlling the perforating positions and/or the number of perforations by the perforating means is configured to control by: (1) the first operation mode for perforating a predetermined number of punch holes on the edge of the sheet; and (2) the second operation mode for forming a predetermined number of uneven grooves on the end of the sheet. Thus, the following remarkable effects are provided.

The punch holes for a binder and the uneven grooves for binding a booklet can be selectively formed by the circular punching blades, respectively, according to finishing conditions. Therefore, unlike in the conventional art where a perforating mechanism for the binder holes and that for binding a booklet need to be individually incorporated within the device, the device can be configured small and compact.

That is, when forming the punch holes at the time of stacking and storing the sheets forwarded along the convey-in path in the storage stacker, the binder holes can be formed by perforating a predetermined number of punch holes on edge of the distal end or the rear end of the sheet along the convey-in path. Also when binding the sheets from the convey-in path in a booklet, roughened uneven grooves are formed on the spine-closure edge by forming the notch holes in an uneven shape on the edge of the distal end or the rear end of the sheets along the convey-in path, and by the adhesive flown between the grooves, the sheets can be surely stitched together.

In particular, in the present invention, the crenellated notch-holes are formed by the perforating cutters for forming the circular punch holes on the spine-closure edge of the sheets when binding the sheets into a booklet, and thus, the positions of the perforating cutters relative to the sheet edge can be adjusted to change the size of the notch holes, e.g., a small size or a large size. Therefore, when the thickness of sheets to be bound into a booklet is large, e.g., sheet of 100 pages are bound into a booklet, the notch holes can be set large according to the specification of the device. This enables accurate bonding in which sheets do not come loose.

Further, in the present invention, the perforating means is configured to form a plurality of punch holes simultaneously, and in the aforementioned second operation mode, the size, the number, positions of the notch holes are changed according to a sheet material quality, a sheet size, a sheet basis weight, and the number of sheets to be collated. This enables the accurate binding of a sheet bundle into a booklet with a relatively lesser number of grooves.

Also, in the present invention, the sheets sequentially fed along the convey-in path are formed with the crenellated notch-holes so as to bind the sheets into a booklet. Thus, the number and positions of holes can be changed for each sheet to be collated. Thereby, the adhesive can be surely permeated through the sheets, which enables the more accurate binding of a sheet bundle into a booklet.

BRIEF DESCRIPTION OF THE SEVERAL VIEWS OF THE DRAWINGS

FIG. 3 illustrates the configuration of adhesive application means in the bookbinder of FIG. 2, wherein

FIG. 5 is explanatory views of a perforating mechanism of the punch unit in the bookbinder of FIG. 4, wherein

FIG. 6 is explanatory views of a perforated state of punch holes in the bookbinder of FIG. 2, wherein FIG. 6D shows a the spine-closure portion when the crenellated notch-holes are formed in different positions.

FIG. 7 is explanatory views of the operation states showing a fed state of a coversheet in the bookbinder in FIG. 2, wherein

FIG. 8 is explanatory views of a state that the coversheet is bound in the bookbinder of FIG. 2, wherein

DETAILED DESCRIPTION OF THE INVENTION

Figure 1:
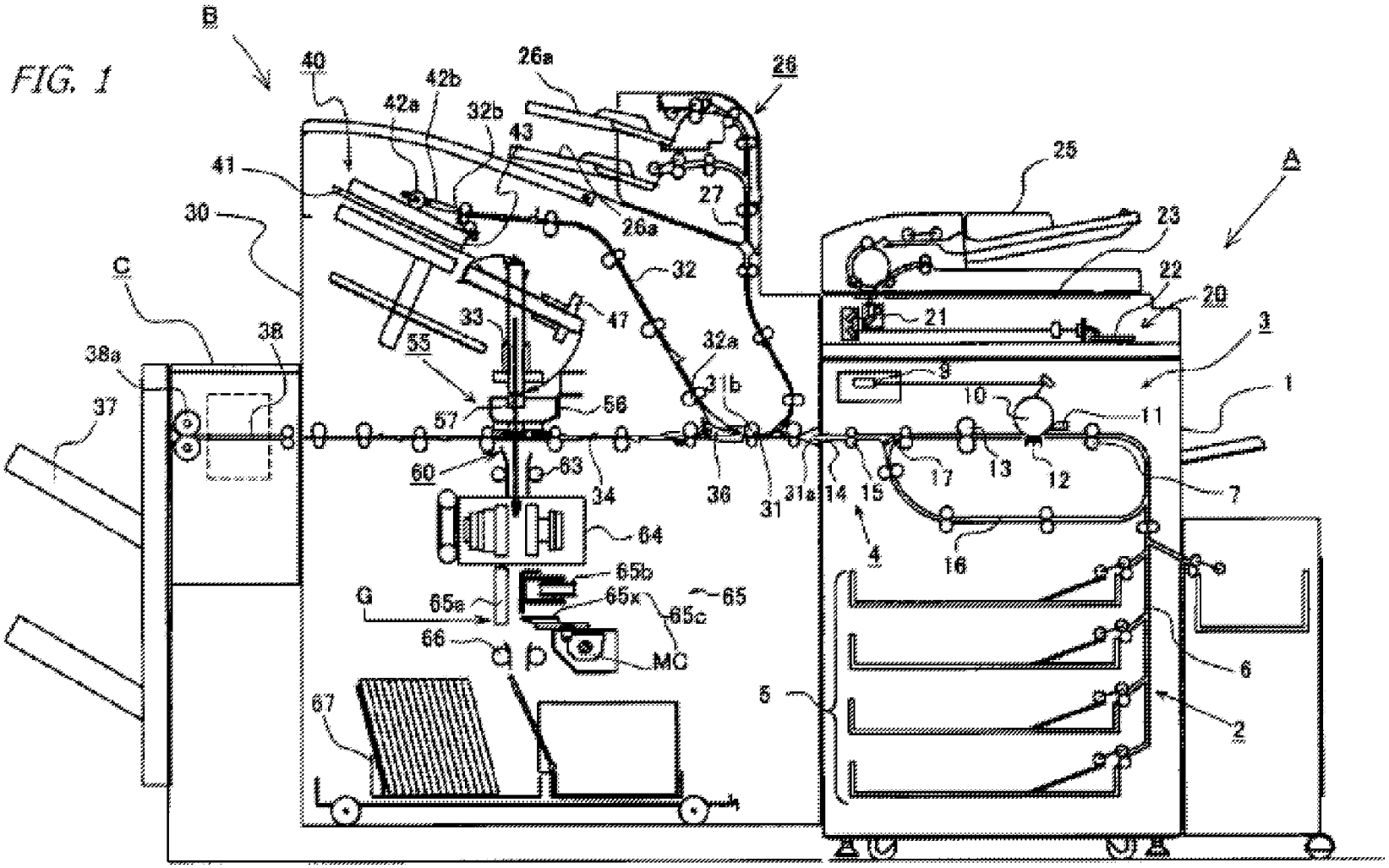
FIG. 1 Prior Art
FIG. 1 is a view of the overall configuration of an imaging system equipped with a bookbinder according to the present invention.
Figure 2:
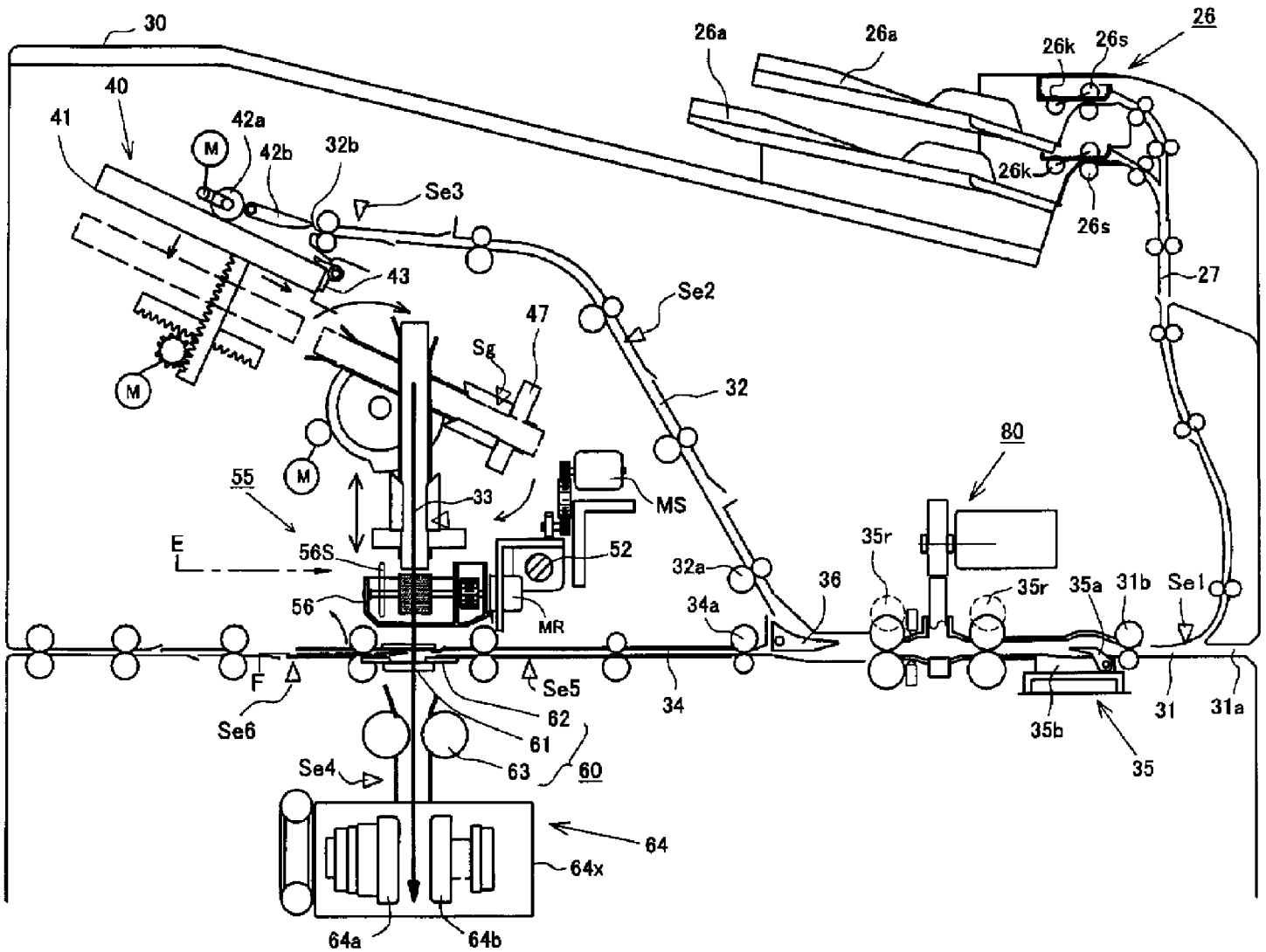
FIG. 2 is an explanatory view of main parts of the bookbinder in the system in FIG. 1.

The present invention will now be explained in detail based on the preferred embodiment provided below. FIG. 1 is an explanatory view of the entire configuration of a bookbinder according to the present invention and an imaging system using the same. FIG. 2 is a detailed explanatory view of the bookbinder.

As shown in FIG. 1, the imaging system according to the present invention is configured by an imaging device A and a bookbinder B. The imaging device A sequentially forms images on sheets. The bookbinder B collates sheets, which are connected to a sheet-discharge outlet 14 of the imaging device A and formed thereon with images, in a bundle. The sheets are then bound into a booklet. Thereafter, a bundle of sheets which are bound into a booklet is cut. The bookbinder in FIG. 1 is further equipped with a finisher C at a downstream side of the bookbinder B. Detailed configuration of each device is explained later.

Imaging Device Configuration

Initially, the imaging device A can employ a variety of structures, such as a copier, printer or printing machine, but in FIG. 1, an electrostatic printing device is illustrated. The imaging device A is incorporated in the casing 1 with a paper-feeding section 2, a printing section 3, a sheet-discharge section 4, and a control section. A plurality of cassettes 5 that correspond to sheet sizes is disposed in the paper-feeding section 2; Sheets of the sizes instructed by the control section are kicked out and fed to the paper-feeding path 6. A registration roller 7 is arranged in the paper-feeding path 6 to feed a sheet to the downstream printing section 3 at a predetermined timing after the leading edge of the sheet has been aligned.

A static-electric drum 10 is arranged in the printing section 3. A print head 9, a developer 11, and a transfer charger 12, etc., are disposed around this static-electric drum 10. The print head 9 is composed of a laser emitter, for example. A latent image is formed on the static-electric drum 10; the developer 11 adheres toner ink to the latent image; the image is printed onto the sheet by the transfer charger 12. The image is fixed to the printed sheet by a fuser 13, and is then conveyed out to a sheet-discharge path 17. A sheet-discharge outlet 14 formed in the casing 1 and a sheet-discharge roller 15 are disposed in the sheet-discharge section 4. Note that the symbol 16 in the drawing is a cycling path. Printed sheets from the sheet-discharge path 17 are turned over from front to back at a switchback path, then fed again to the registration roller 7 so that images can be formed on the backside of the printed sheet. In this way, sheets printed with images on the front side or on both sides can be conveyed out from the sheet-discharge outlet 14 by the sheet-discharge roller 15.

Note that the symbol 20 in the drawings represents a scanner unit. This optically reads images on an original to be printed by print head 9. The structure is widely known to be composed of a platen 23 where an original sheet is placed; a carriage 21 that travels along the platen 23 to scan the images on an original; and an optical reading means (such as a CCD device) 22 that photo-electrically converts the optical image from the carriage 21. In the drawing, a document feeder 25 that automatically feeds original sheets to the platen is installed above the platen 23.

Bookbinder Configuration

The following will now explain the bookbinder B that is attached to the imaging device A based on FIG. 2. The bookbinder B is composed of a stacking unit 40 that stacks and collates printed sheets in a bundle in the casing 30; an adhesive application means 55 that applies adhesive paste to the sheet bundle conveyed from the stacking unit 40; and cover binding means 60 that binds a coversheet to a sheet bundle that has been applied with adhesive.

Transport Path Configurations

The following will explain each sheet transport path. In the casing 30, a convey-in path 31 having a convey-in inlet 31*a* connected to the sheet-discharge outlet 14 of the imaging device A is arranged from the convey-in path 31, and a cover feed path 34 and an inner-leaf transport path 32 are linked via path switching flapper 36. Also, the inner-leaf transport path 32 is installed consecutively to a bookbinding path (inner-leaf feed path; hereinafter, the same shall apply) 33 via the stacking unit 40, and the cover feed path 34 is linked with a finishing path 38. The bookbinding path 33 is disposed in a direction that traverses the device substantially vertically, and the cover feed path 34 is arranged in a direction that transects the device substantially horizontally.

The bookbinding path 33 and the cover feed path 34 intersect (perpendicular) to each other, and a process stage (cover binding position) F mentioned later is disposed in that intersection section. The convey-in path 31 configured as described above is connected to the sheet-discharge outlet 14 of the imaging device A to receive printed sheets from the imaging device A. In this case, printed sheets (inner leaves) Sn that are printed with content information and printed sheets (coversheet) Sh that are to be used as a front cover and printed with a title, etc., are conveyed out from the imaging device A. In this way, the carry-in path 31 is separated into the inner-leaf transport path 32 and the cover feed path 34; these are interposed by a path switching flapper 36. This selects the path to transport each printed sheet.

An inserter unit 26 is linked to the above-mentioned carry-in path 31. This is configured to separate the coversheets Sh one by one that will not be printed at the imaging device A from a paper-feeding tray means 26*a* and supply it to the convey-in path 31. A kick roller 26*k* and separating means 26*s* are disposed in this paper-feeding tray means 26*a*. Sheets on the tray are kicked out and fed by the kick roller 26*k* after which they are separated by the separating means 26*s* and conveyed out one by one in the downstream side. A sheet feeding path 27 that continues to the carry-in path 31 is arranged at a downstream side of the separating means 26*s*.

A transport roller 31*b* is disposed along the carry-in path 31 whereas a transport roller 32*a* is disposed along the inner-leaf transport path 32. Gripping transport means 47, bundle posture-reorienting means 64 that is described later, and a sheet-discharge roller (sheet-discharge means) 66 are disposed along the bookbinding path 33. A transport roller 34*a* and a transport roller 38*a* are disposed along the cover feed path 34 and the finishing path 38, respectively. They are also respectively linked to driving motors.

Carry-In Path Configuration

Along the carry-in path 31, an aligning mechanism (positioning means: hereinafter, the same shall apply) 35 for aligning the sheets from the carry-in inlet 31*a*, and a punch unit 80 are disposed. FIG. 2 shows the overall configuration, and FIG. 5 shows the detailed configuration. The aligning mechanism 35 is disposed along the convey-in path 31, and the punch unit 80 is disposed at a downstream side of the aligning mechanism 35. The sheets from the carry-in inlet 31*a* are aligned by the aligning mechanism 35, and punch holes (file-binder holes and milling grooves in the present invention) are formed into the sheets. The inner leaves Sn moved to the inner-leaf transport path 32, and the coversheet Sh is moved to the cover feed path 34. Note that in the present invention, the sheets perforated with the binder holes are transferred via the cover feed path 34 to the finishing path 38. This control is described later.

The aligning mechanism 35 is arranged along the carry-in path 31. This mechanism is configured by; a nipping claw (regulating means: hereinafter, the same shall apply) 35*a* that locks the rear end of the coversheet Sh; an aligning member 35*b* that offsets the coversheet Sh held by the nipping claws 35*a* in a transport-orthogonal direction; and a forward and reverse rotating roller (roller means) 35*r* which is switched back so as to push against the coversheet Sh sent to the cover feed path 34 by the nipping claw 35*a*. The forward and reverse rotating roller 35*r* is configured such that it can elevate from the coversheet Sh to a waiting position evacuated in the upward direction.

The above-mentioned forward and reverse rotating roller 35*r* is configured by the roller means for moving the sheets to the punch unit 80 disposed at a downstream side of the aligning mechanism 35. Accordingly, after the rear end position of the sheet is regulated by the aligning mechanism 35, positions at which the punch holes are perforated are set by a transfer amount of the roller 35*r*. That is, the transfer amount of the forward and reverse rotating roller 35*r* determines whether holes are to be perforated from the rear end of the sheet in predetermined binder-holes positions or whether crenellated notch-holes (concave grooves) are to be perforated on the rear edge of the sheets.

After the rear end of the coversheet Sh conveyed along the carry-in path 31 passes through the aligning mechanism 35, it is switched back and then transported by the reverse rotation of the forward and reverse rotating roller 35*r*. When this happens, the rear end of the sheet is pushed against the nipping claw 35*a*, and it undergoes skew (oblique) correction. In this state, the nipping claw 35*a* holds the rear end of the sheet and the aligning member 35*b* on which the nipping claw 35*a* is mounted is pulled over in the transport-orthogonal direction. The coversheet Sh undergoes skew correction in the back-and-forth transport directions, and the position in the width direction (transport-orthogonal direction) is to be corrected (lateral-edge position is corrected). Thus, the coversheet Sh that has undergone the aligning correction is set to be transported by the forward and reverse rotating roller 35*r* to a process stage F at a downstream side. The setting and feeding to the process stage F is done by transporting a predetermined amount of coversheets Sh from the aligning position. Moreover, in a case of the coversheet Sh, holes are not perforated by the punch unit 80 at a downstream side of the aligning mechanism 35.

Figure 4:
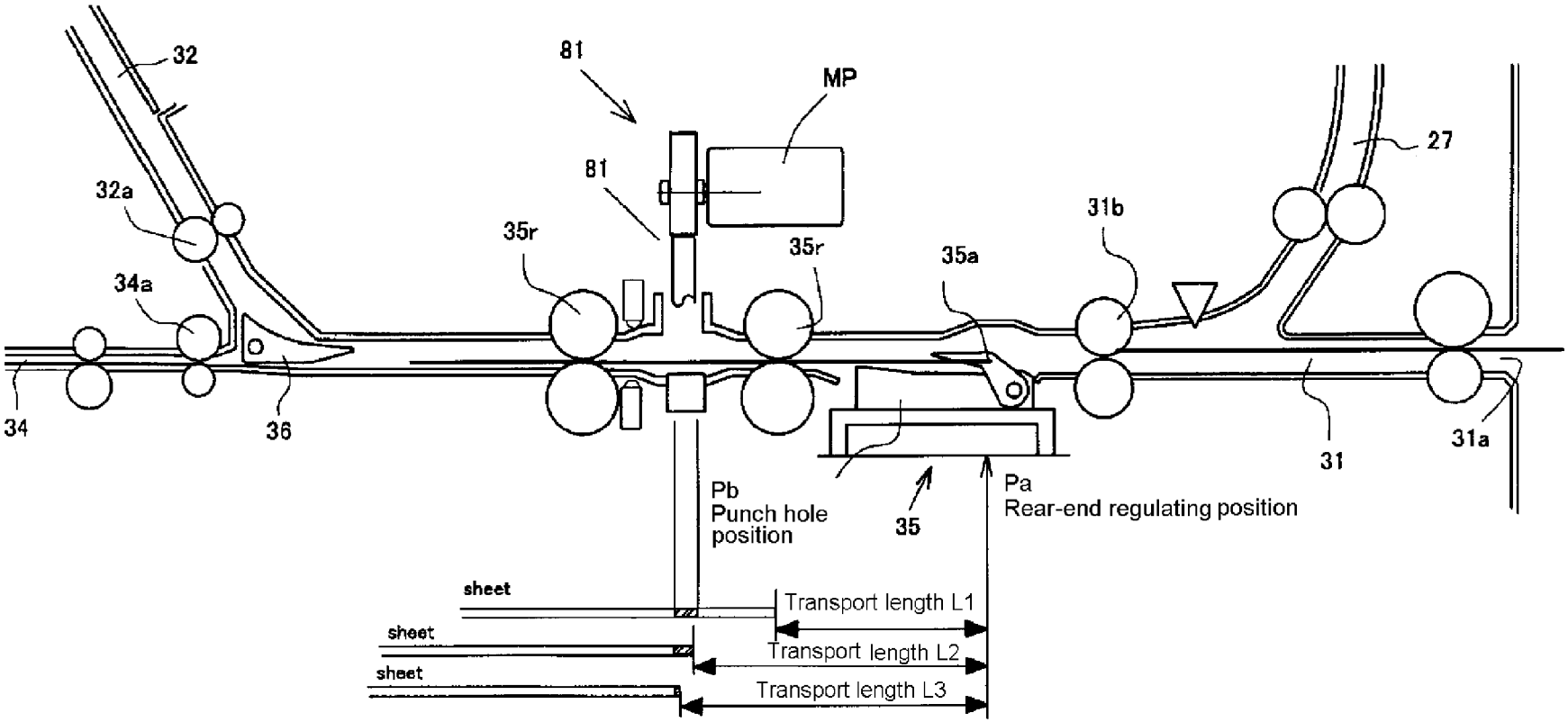
FIG. 4 is an explanatory view showing the overall configuration of a punch unit in the bookbinder in FIG. 2.

Punch Unit Configuration (Cf. FIGS. 4 and 5)

Figure 5A:
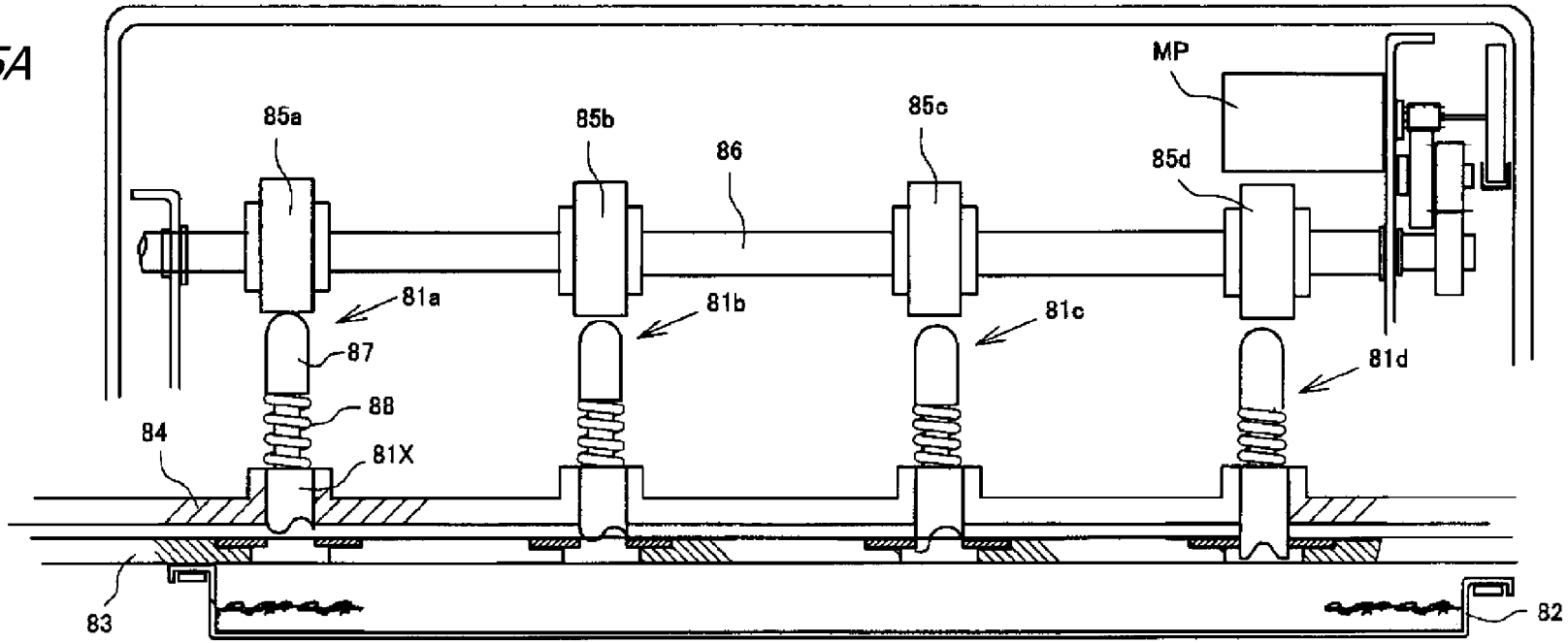
FIG. 5A presents an explanatory view of the overall mechanism thereof.
Figure 5B:
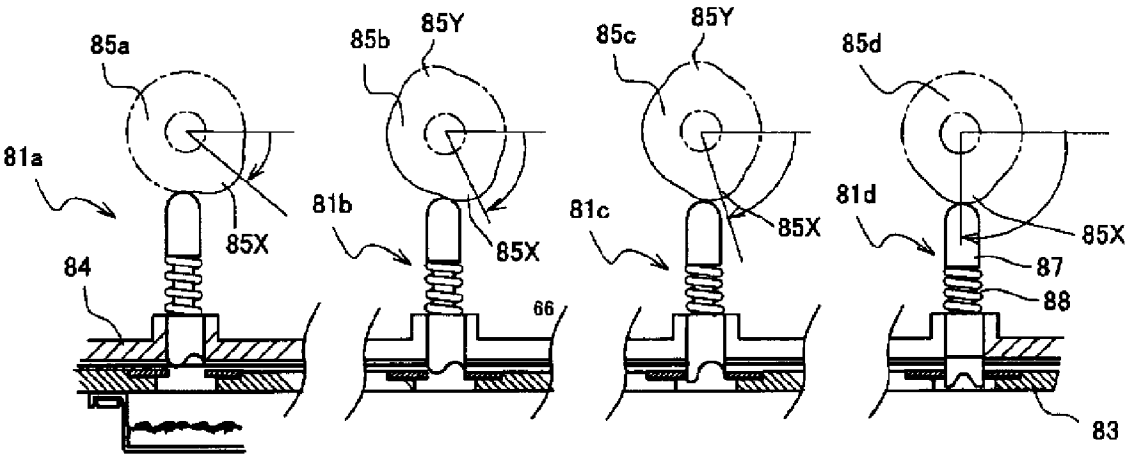
FIG. 5B is an explanatory view of a drive cam mechanism of each punch member.

The configuration of the punch unit 80 is described based on FIGS. 5A and 5B. The punch unit 80 is configured by: a lower frame 83 on which the sheets are mounted, an upper frame 84 which has a small gap with the lower frame 83, a punch member 81 that is disposed on the upper frame 84, and the driving cam 85 that moves the punch member 81 up and down.

A punch driving motor MP and a driving axis 86 that is linked to the punch driving motor MP are disposed on the upper frame 84, as shown in FIG. 5A. The punch member 81 is fitted and supported to the upper frame 84 such that it can freely slide up and down. The punch member 81 is appropriately disposed on a plurality of locations. As shown in FIG.

5A, first to fourth punch members 81*a*, 81*b*, 81*c*, and 81*d* are disposed at predetermined intervals on four locations.

The punch member 81 is formed of SUS steel, etc., and a perforating cutter 81X is formed at the front end. A guard flange 87 is provided on the axis of the punch member 81, and a reversion spring 88 is disposed on the guard flange 87. As shown in FIG. 5B, the driving cam 85 is attached to the above-mentioned driving axis 86. A first driving cam 85*a* is disposed in the position opposite the first punch member 81*a*, and a second driving cam 85*b* is disposed in the position opposite the second punch member 81*b*. Likewise, a third driving cam 85*c* and a forth driving cam 85*d* are disposed. FIG. 5B also illustrates positional relationships of the punch members 81*a* to 81*d* corresponding to the driving cams 85*a* to 85*d* composed of an eccentric cam axially supported by the driving axis 86.

A first cam face 85X is formed in one location in the first and fourth driving cams 85*a* and 85*d*, respectively. The first cam face 85X and a second cam face 85Y are each formed in two locations in the second and third driving cams 85*b* and 85*c*, respectively. For each of the driving cams 85*a* to 85*d*, the first cam face 85X is substantially simultaneously engaged with heads of the first to fourth punch members 81*a* to 81*d*, in the driving axis 86. Accurately speaking, these perforating positions are engaged after waiting for a very small time difference (phase difference) in the order of the first punch member 81*a*, the second punch member 81*b*, the third punch member 81*c*, and the fourth punch member 81*d*. This is for lessening the perforation load exerted on the punch driving motor MP.

If the driving axis 86 is rotated clockwise at a predetermined angle (e.g., 90 degrees) from a home position as shown in FIG. 5B, the first, second, third, and fourth punch members 81*a* to 81*d* move in the perforating direction to perforate four holes in the sheet. On the other hand, if the driving axis 86 is rotated counterclockwise at a predetermined angle (e.g. 90 degrees), and when it is rotated at a predetermined angle (e.g. 90 degrees) at the position of the first cam face 85X, the second and third punch members 81*b* and 81*c* perforate two holes in the sheet. After the perforation, each punch member 81*a* to 81*d* returns to its original position by the reversion spring 88. Although not shown, an encoder and an encode sensor are disposed in the punch driving motor MP, and a position sensor is disposed at the home position of the driving axis 86. Accordingly, the two perforations or the four perforations are selected by angular control of the driving cam 85, based on rotation control of the punch driving motor MP, and as a result, punch holes are perforated at predetermined positions on the sheet by each punch member 81*a* to 81*d*. Note that the symbol 82 in the drawings denotes a waste box.

Stacking Unit Configuration

A stacking tray 41 disposed in the sheet-discharge outlet 32*b* of the above-mentioned inner-leaf transport path 32 stacks and stores the sheets from the sheet-discharge outlet 32*b* in a bundle. As shown in FIG. 2, the stacking tray 41 is configured by a tray member disposed at a substantially horizontal posture, and a forward and reverse rotating roller 42*a* and a carry-in guide 42*b* are provided above. The printed sheets from the sheet-discharge outlet 32*b* are guided onto the stacking tray 41 by the carry-in guide 42*b*, and stored by the forward and reverse rotating roller 42*a*. By a forward rotation, the forward and reverse rotating roller 42*a* moves the printed sheets to the front end side of the stacking tray 41, and by a reverse rotation, it regulates them by pushing the rear end of the sheet against a regulating member 43 disposed at the rear end of the tray (the right edge of FIG. 2). Sheet-side aligning means not shown is arranged in the stacking tray 41, and the edges on the both sides of the printed sheets stored on the tray are pulled over and aligned to a reference position. With such a configuration, the printed sheets from the inner-leaf transport path 32 are piled on top of one another on the stacking tray 41, and then, collated in a bundle.

Sheet-bundle-thickness identifying means not shown is disposed in the above-mentioned stacking tray 41 so that the thickness of the sheet bundle stacked on the tray is detected. In this configuration, for example, a paper contact segment that contacts the topmost sheet is arranged on the tray so that a position of the paper contact segment is detected by a sensor, thereby identifying the thickness of the sheet bundle. Another example of the sheet-bundle-thickness identifying means includes that in which the sheets discharged onto the stacking tray are detected from a sheet-discharge sensor Se3, for example, a counter for counting the signals from the sheet-discharge sensor Se3 is arranged, and the average sheet thickness is multiplied by the total number of sheets counted by a job ending signal from the imaging device A.

Sheet-Bundle Transport Means Configuration

Along the bookbinding path 33, gripping transport means 47 for moving the sheets from the stacking tray 41 to an adhesive-layer forming position E at the downstream side is disposed. The gripping transport means 47 reorients the sheet bundle stacked in the stacking tray 41 as shown in FIG. 2 from a horizontal posture to a vertical posture, and sets to transport the sheet bundle to the adhesive-layer forming position E along the bookbinding path 33 disposed substantially vertically. Due to this, the stacking tray 41 is moved from a stacking position (solid lines in FIG. 2) to a hand-over position (dotted lines in FIG. 2), and hands over the sheet bundle to the gripping transport means 47 that is prepared at this hand-over position.

Adhesive Application Section Configuration

Figure 3A:
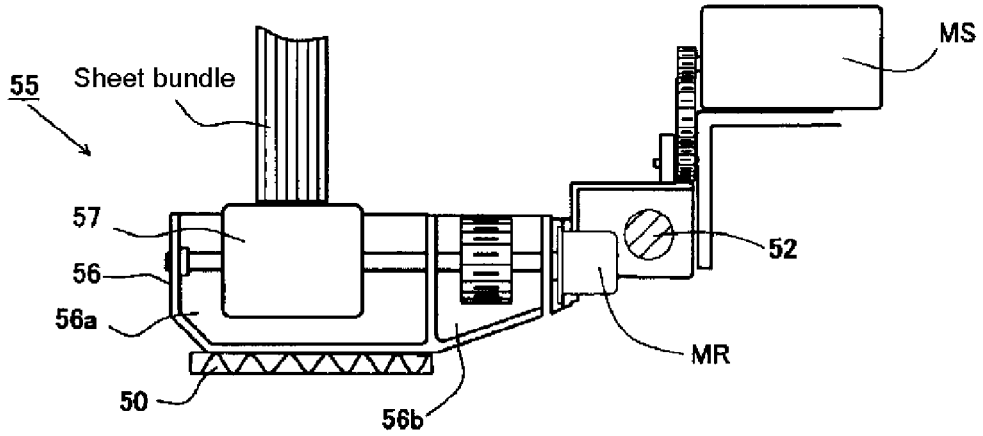
FIG. 3A is a schematic diagram of a glue container.

Adhesive application means (adhesive-layer forming means; hereinafter, the same shall apply) 55 is disposed in the adhesive-layer forming position along the bookbinding path 33. As shown in FIG. 3A, the adhesive application means 55 is configured by a glue container 56 containing hot-melt adhesive, an applying roll 57, and a roll rotating motor MR. The glue container 56 is sectioned into a liquid-adhesive containing chamber (hereinafter, referred to as liquid-agent containing chamber) 56*a* and a solid-adhesive containing chamber (hereinafter, referred to as a solid-agent containing chamber) 56*b*. The applying roll 57 is incorporated in the liquid-agent containing chamber 56*a* such that it can rotate freely. A glue sensor 56S (see FIG. 2) that detects a residual amount of the adhesive is disposed in the liquid-agent containing chamber 56*a*. The illustrated glue sensor 56S serves also as a temperature sensor for adhesive, and detects the temperature of the adhesive that has liquefied within the liquid-agent containing chamber 56*a*, and at the same time, detects the residual amount of adhesive by a temperature difference of a region immersed with adhesive. Heating means 50 such as an electric heater is buried in the glue container 56. This glue sensor 56S and the heating means 50 are wired-connected to a control CPU 75 described later, and they adjust the temperature of the adhesive within the liquid-agent containing chamber 56*a* to a predetermined melting temperature. The applying roll 57 is composed of a heat-resistant porous material so that when it is impregnated with glue, a glue layer is heaped up around the roll.

Figure 3B:
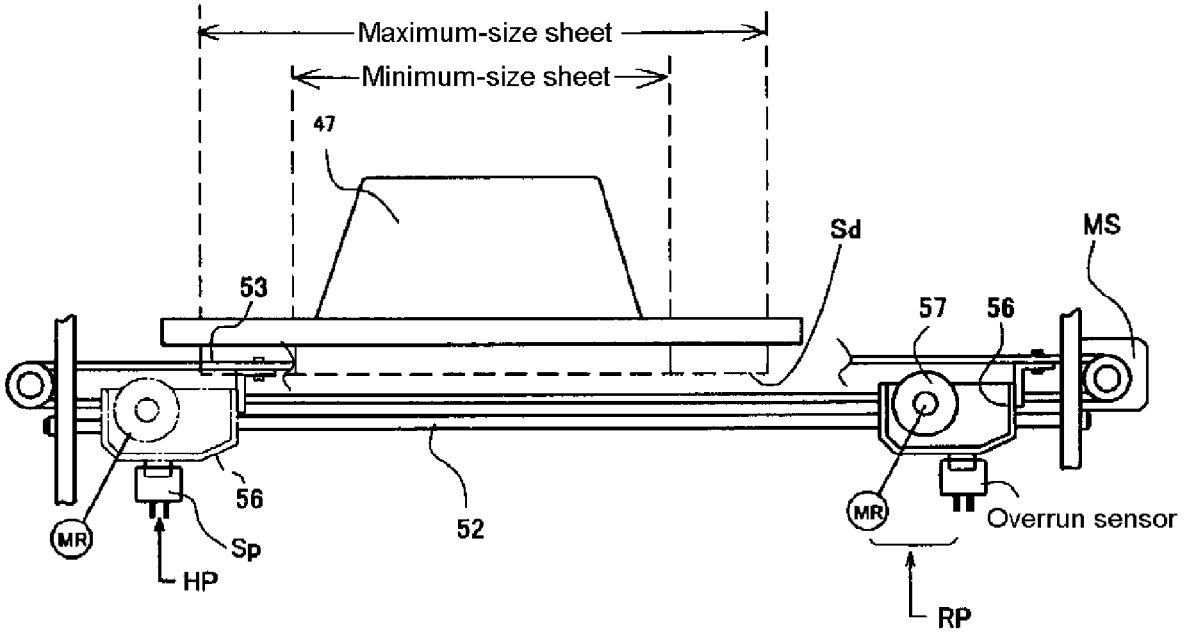
FIG. 3B is an explanatory view showing a manner in which adhesive is applied.

The glue container 56 thus configured is reciprocated along the sheet bundle. FIG. 3B illustrates a conceptual diagram thereof. The glue container 56 is so formed that the length (dimension) is shorter than the lower edge (spine cover at the time of bookbinding) Sd of the sheet bundle. The glue container 56 is supported by a guide rail 52 of the device frame such that it can move, together with the applying roll 57 incorporated therein, along the lower edge Sd of the sheet bundle. This glue container 56 is linked to a timing belt 53 attached to the device frame. The driving motor MS is linked to this timing belt 53.

The glue container 56 is reciprocated between the home position HP and the return position RP (from which the return operation is started along the sheet bundle) by means of the driving motor MS. Each position is set according to the positional relationship shown in FIG. 3B, and the return position RP is set by size information about a sheet width. When the power supply of the device is inputted (at an initial time), the glue container 56 is set to the home position HP. For example, the glue container 56 moves from the home position HP toward the return position RP after a predetermined time (estimated time at which the sheet bundle reaches the adhesive-layer forming position E) elapses from a sheet grip signal of the grip sensor Sg that is arranged in the gripping transport means 47 arranged before. Along with this movement, the applying roll 57 starts rotating by the roll rotation motor MR. Note that Sp in FIG. 3B denotes a home position sensor of the glue container 56. The adhesive application means 55 thus configured glue starts moving the glue container 56 along the guide rail 52, from the left side to the right side of FIG. 3B, by the rotation of the driving motor MS. The transport amount of the gripping transport means 47 is so adjusted by an elevator motor not shown that on the forward path, the applying roll 57 is pressed against the sheet bundle so that the sheet ends are unbound while on the return path to return from the return position RP to the home position HP, a predetermined gap is formed with the sheet ends so that the adhesive can be applied therebetween.

Cover Binding Means Configuration

The cover binding means 60 is disposed in a process stage F of the above-mentioned bookbinding path 33. As shown in FIG. 2, the cover binding means 60 is configured by a back support plate 61, a spine folding plate 62, and a folding roll 63. The cover feed path 34 is disposed in the process stage F so that the coversheet Sh is fed from the imaging device A or the inserter unit 26. The back support plate 61 is composed of a plate like member that backs up the coversheet Sh, and is disposed to retract freely along the bookbinding path 33. An inner leaf bundle Sn is joined in an inverted T-letter shape to the coversheet Sh supported by the back support plate 61. The spine folding plate 62 is configured by a pair of right and left press members. The pair is so configured to keep closely to and apart from each other by driving means not shown in order to fold the spine of the coversheet joined in an inverted T-letter shape. The folding roll 63 is configured by a pair of rollers for compressing the sheet bundle of which the spine is folded to finish the folding.

Bundle Posture-Reorienting Means Configuration

Subsequently, the finishing process of the sheet bundle bound into a booklet (as mentioned above) will now be explained. This finishing process involves trimming 3 sides for alignment excluding the spine of the sheet bundle that has been made into a booklet. Due to this, the bundle posture-reorienting means 64 that reorients the vertical direction of the sheet bundle and trimming means 65 that trims the edges of the sheet bundle are disposed in a trimming position G positioned at a downstream side of the folding roll 63. The bundle posture-reorienting means 64 reorients the sheet bundle of which the cover is provided from a cover binding position F in a predetermined direction (posture) and feeds it to the trimming means 65 or a storage stacker 67 at a downstream side. This trimming means 65 trims and aligns the edges of the sheet bundle. Due to this, the bundle posture-reorienting means 64 is equipped with rotation tables 64*a* and 64*b* for holding and rotating the sheet bundle forwarded from the folding roll 63. As shown in FIG. 2, these rotation tables 64*a* and 64*b* are arranged in a unit frame 64*x* that is attached to the device frame in a freely elevated manner. A pair of rotation tables 64*a* and 64*b* are each axially supported to rotate freely across the bookbinding path 33 in the unit frame 64*x*. One movable rotation table 64*b* is supported to move freely in a sheet bundle-thickness direction (in a direction orthogonal to the bookbinding path 33). A swing motor not shown is arranged in the bookbinding path 33 in each of the rotation tables 64*a* and 64*b* so as to reorient the posture of the sheet bundle.

Trimming Means Configuration

Trimming means 65 is disposed at a downstream side of the bundle posture-reorienting means 64. As shown in FIG. 1, this trimming means 65 is configured by a trimming edge press member 65*b* that pressingly supports the trimmed edges of the sheet bundle to a blade bearing member 65*a*, and a trimming blade unit 65*c*. The trimming edge press member 65*b* is disposed in a position opposite the blade bearing member 65*a* disposed along the bookbinding path 33, and is composed of a pressurizing member that moves in a direction orthogonal to the sheet bundle by means of driving means not shown. The trimming blade unit 65*c* is configured by a chopping blade (with a flat blade) 65*x* and a cutter motor MC that drives it. Thus, by using the thus-configured trimming means 65, the edges (excluding the spine) of the sheet bundle that has been made into a book are cut and aligned in a predetermined amount.

The sheet-discharge roller (sheet-discharge means) 66 and the storage stacker 67 are disposed at a downstream side of the trimming position G. This storage stacker 67 stores the sheet bundle in an upright posture, as shown in FIG. 1. As shown in FIG. 1, the storage stacker 67 is disposed in the casing 30 in a drawer-like fashion, can be pulled out to the front side of the device (front side of FIG. 1), and can be viewed from top by a user when it is pulled out to the front side of the device.

Finisher Configuration

The finisher C is disposed in the bookbinder B, and the finishing path 38 that continues to the cover feed path 34 is provided in this finisher C. Finishers such as a staple unit and a stamp unit are disposed in the finishing path 38. Printed sheets from the imaging device A are received via the cover feed path 34, and they are conveyed out to the paper-discharge tray 37 after staples, and stamps and seals are applied to the printed sheets. It is also possible to not apply any finishing process on printed sheets and to store them in the sheet-discharge tray 37 directly from the imaging device A.

Control Means Configuration

Figure 9:
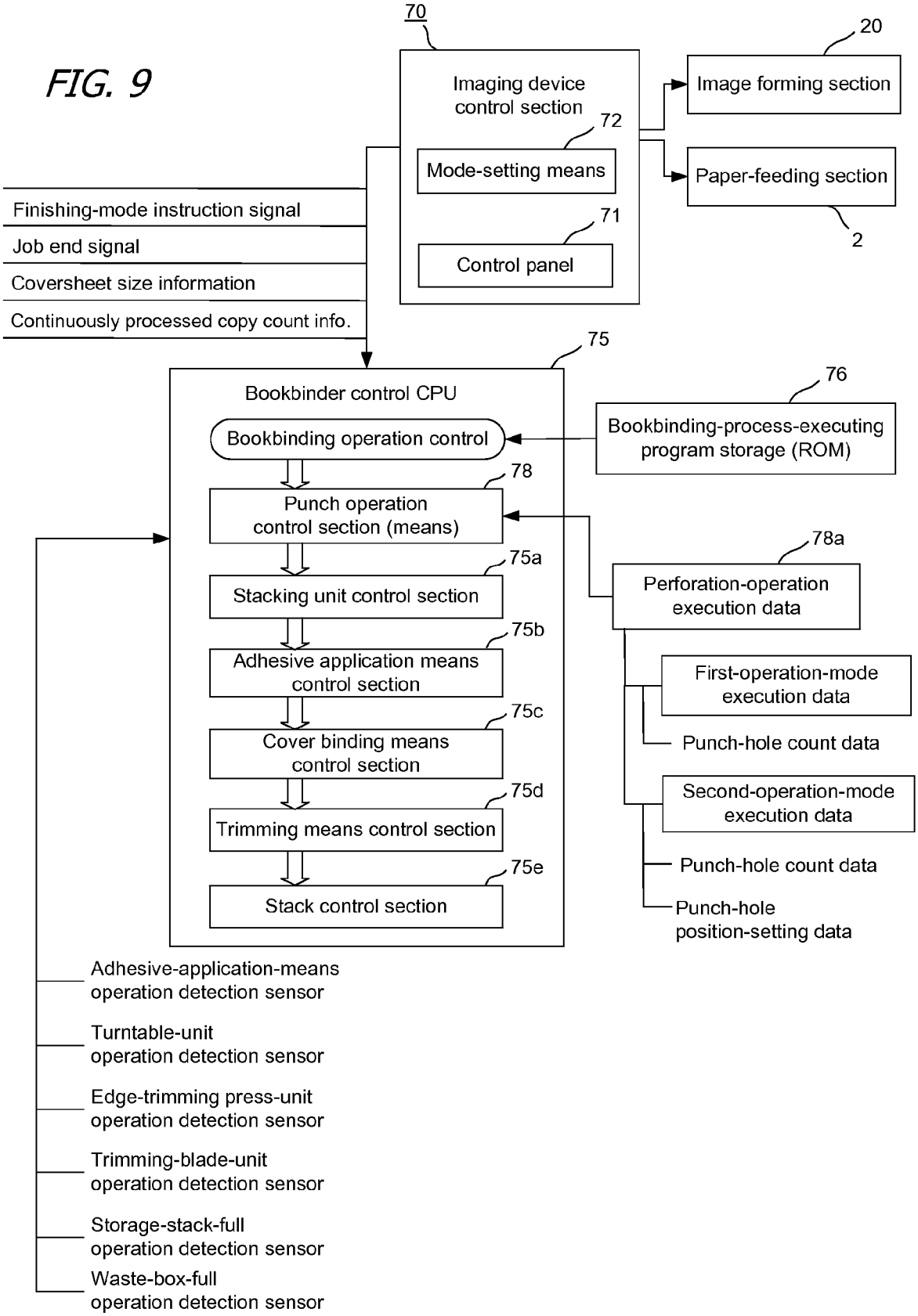
FIG. 9 is an explanatory view of a control configuration in the system of FIG. 1.

Next, based on FIG. 9, the configuration of the control means in the above-mentioned device will now be explained. FIG. 9 is a control block diagram. As shown in FIG. 1, in the system that links the imaging device A and the bookbinder B, the control panel 71 and mode setting means 72 are arranged to the control CPU 70 provided on the imaging device A. A control CPU 75 is equipped in the control section of the bookbinder B. This control CPU 75 calls up a bookbinding execution program from the ROM 76 and executes each process in the bookbinding path 33.

This control CPU 75 receives a finishing mode instruction signal, a job end signal, sheet size information, and other information and command signals required in the bookbinding process from the control CPU 70 of the imaging device A. Sheet sensors Se1 to Se6 for detecting the sheets (sheet bundle) to be transported are disposed in the carry-in path 31, the bookbinding path 33, and the cover feed path 34, respectively, at the positions illustrated in FIG. 2. Detection signals of the sheet sensors Se1 to Se6 are transmitted to the control CPU 75. The control CPU 75 is furnished with "perforation control means 78", a "stacking unit control section 75*a*", an "adhesive-application-means control section 75*b*", a "cover-binding-means control section 75*c*", a "trimming means control section 75*d*", and a "stacker control section 75*e*". Perforation-operation-execution-controlling-data storing means (RAM) 78*a* is provided in the perforation control means 78.

In the aforementioned device configuration and the control configuration of the present invention, holes are punched in the sheets conveyed from the imaging device A to the carry-in path 31 in a subsequent first operation mode and second operation mode.

Perforation Control Means Configuration (Cf. FIG. 9)

The aforementioned punch unit 80 is controlled in the following first operation mode and second operation mode.

First Operation Mode

This operation mode is used for perforating the punch holes for a binder in the sheets from the carry-in path 31. The punch holes for a binder are perforated in the rear end of the sheets on which images are formed. For this, when a "binder-holes perforating mode" is selected by the mode setting means 72, the perforation control means 78 controls the forward and reverse rotating roller 35*r* so that the rear end of the sheets conveyed to the carry-in path 31 is positioned at the rear end position by the aligning mechanism 35. These sheets are moved from a positioning position Pa to a punch position Pb (shown in FIG. 4) by a predetermined length (L1). In this movement control, the number of power source pulses supplied to the driving motor (PWM control) that rotates the forward and reverse rotating roller 35*r* is controlled so as to set a transport length L1. The transport length L1 in the first operation mode is set in advance and stored in a RAM 78*a*. The perforation control means 78 rotates counterclockwise the driving cam 85 that elevates the punch member 81 in a case of the two perforations (FIG. 5B) while rotates it clockwise in a case of the four perforations. This is to be done by rotation control of the punch driving motor Mp that is linked to the rotation axis 85.

Figure 6A:
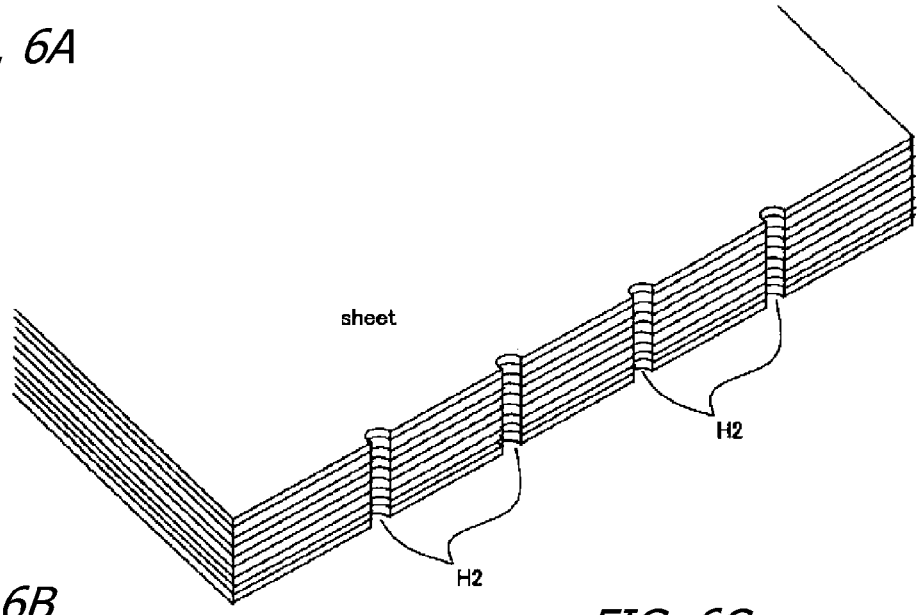
FIG. 6A shows a state that crenellated notch-holes are perforated on the edge of the sheet.
Figure 6B:
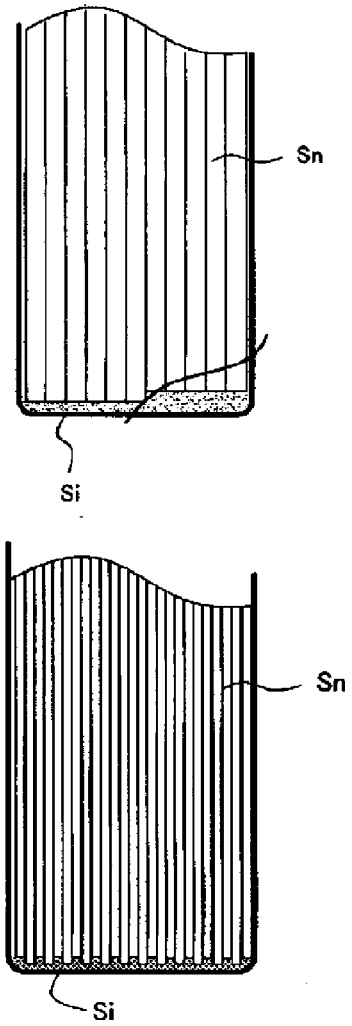
FIG. 6B shows a state that a spine-closure portion is bookbinding-finished.
Figure 6C:
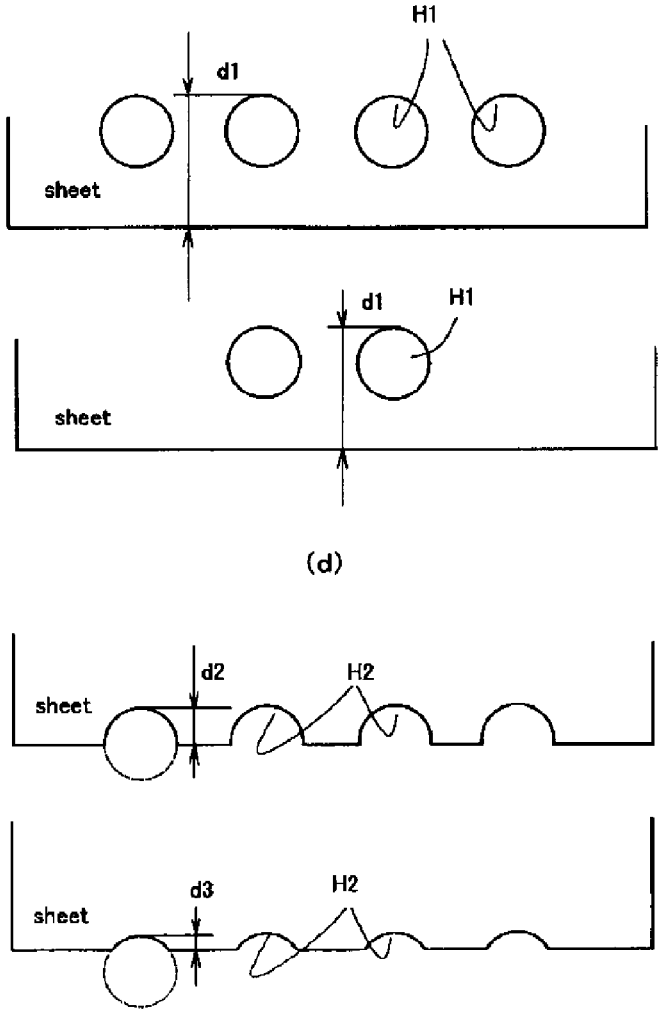
FIG. 6C is a positional relationship of holes when forming the punch holes.

The transport length L1 is set in advance according to the binder file standard, etc. As FIG. 6 illustrates the positional relationship of the punch holes (C1: 4 holes) and (C2: 2 holes), a hole position d1 from the edge of the sheet is set according to the standard and stored in the RAM 78*a*. After perforating binder holes H1 (2 holes or 4 holes) in the sheets conveyed to the carry-in path 31, the control CPU 75 feeds these sheets to the cover-transport path 34 by the flapper 36. These sheets are then transported via this path to the finishing path 38 of the finisher C disposed at the downstream side. In this finisher C, the sheets on which binder holes have been perforated are collated in a bundle, bound together by staples, and then stored in the paper-discharge tray 37.

Second Operation Mode

This operation mode is used for forming crenellated notch-holes (roughening grooves: hereinafter referred to as a milling process) on the edge of the sheets from the carry-in path 31. For this, when a "bookbinding processing mode" is selected by the mode setting means 72, the perforation control means 78 controls the forward and reverse rotating roller 35*r* so that the rear end position of the sheets conveyed to the carry-in path 31 is positioned by the aligning mechanism 35. These sheets are moved from the positioning position Pa to the punch position Pb by a predetermined length (L2 or L3). In this movement control, the number of power source pulses supplied to the driving motor (PWM control) that rotates the forward and reverse rotating roller 35*r* is controlled so as to set a transport length L1. The transport length L2 or L3 in the first operation mode is set in advance and stored in the RAM 78*a*. The perforation control means 78 rotates the driving cam 85 that elevates the punch member 81 in a counterclockwise direction (FIG. 5B). This is to be done by rotation control of the punch driving motor Mp that is linked to the rotation axis 85. On performing this operation, four holes are perforated in the sheet.

The aforementioned transport length L2 or L3, a distance d2 and a distance d3 shown in FIG. 6D are stored in a RAM 86*a* in advance. In either case, the transport length L2 (or L3) is so set that crenellated notch-holes H2 are formed on the edge of the sheets. A method for perforating the notch holes H2 is described later.

As described above, after the notch holes (milling holes) H2 are perforated in the sheets conveyed to the carry-in path 31, the control CPU 75 feeds these sheets to the inner-leaf transport path 34 by the flapper 36. After that, along this path, the adhesive is applied to the spine-closure edge on which the notch holes (milling holes) have been formed. The procedure for applying the adhesive is as described above. After the adhesive is applied, the control CPU 75 binds together the sheet bundle and the coversheet, and stores it in the stacker 67.

Thus, the present invention is characterized in that: in the "binder-hole perforating" mode, two or four punch holes are formed by the punch unit 80 in the hole positions according to the standard on the image-formed sheets conveyed to the carry-in path 31, and the sheets are then stored in the paper-discharge tray 37 that is disposed at a downstream side of the carry-in path 31; and at the same time, in the "bookbinding process" mode, crenellated notch-holes (milling holes) are formed on the edge of the sheets, and the sheets are then conveyed out to the inner-leaf transport path 32 that is positioned at a downstream side.

Now, a mode for forming the crenellated notch-holes H2 (hereinafter referred to as a "milling process") will be described below.

First Milling Process Method

This is a method for forming perforating distances (d2 and d3) for the crenellated notch-holes H2 in previously set fixed positions. The transport length L2 is set to a constant value, and stored in the RAM 86*a* in advance. Thereby, uneven grooves having a predetermined number of holes (four holes in FIG. 6) are formed on all the sheets transported to the inner-leaf transport path 32. These sheets are collated and stacked in the stacking tray 41, and the adhesive is applied to the spine-closure edge of the sheets perforated with the notch holes H2 at a glue applying position E. At this time, the adhesive strength increases because the uneven grooves are formed on the sheet bundle.

Second Milling Process Method

Size of holes in the crenellated notch-holes H2 is adjusted based on sheet information such as the material quality of sheet paper, paper size, basis weight of the sheets, and the number of sheets to be collated. In this case, the perforation control means 68 is so configured to set the transport lengths L1 and L2 depending on the following information: (1) size information of the sheet transferred from the imaging device A; (2) information regarding the material quality of sheet paper, (3) basis weight of the sheet, and (4) the number of sheets to be collated (thickness of the bundle), entered by the user, for example. At this time, when the sheet size is large, the hole position d is set larger as compared to a case that the sheet size is small. Due to this, the depth of the uneven grooves increases, which further increases the adhesive strength. When the sheet material quality makes the adhesion difficult, e.g., in a case of a coating sheet, the hole position d is set larger as compared to standard paper that relatively facilitates the adhesion. Also, when the basis weight of the sheet (the thickness of the sheet) is large, the hole position d is set larger as compared to a smaller basis weight. When the number of sheets to be collated is large, the hole position d is set larger as compared to a smaller number. Due to this, the depth of the uneven grooves increases, which further increases the adhesive strength.

Third Milling Process Method

The number of the crenellated notch-holes H2 is adjusted (whether to increase or decrease the number) based on the sheet information such as the material quality of the sheet, paper size, the basis weight of the sheet, and the number of sheets to be collated. Similar to the second milling method, the number of notch holes is adjusted so that two or four holes are formed. Its control method is similar to that described above. The number of holes is set large in the following cases: the sheet size is large, the sheet material quality makes the adhesion difficult, the sheet basis weight is large, the number of sheets to be collated is large. In doing so, the number of holes of uneven grooves increases, which increases the adhesive strength.

Fourth Milling Process Method

Positions and/or the number of the crenellated notch-holes H2 are so set that they are differ for each collated and stacked sheets. For example, the hole positions (or the number of holes) on the first sheet are set differently from the hole positions (or the number of holes) on the second sheet. As a result, the sheets in which the positions of holes or the number of holes are differed are piled on top of one another along the spine-closure surface of the sheet bundle, and the adhesive is applied. Likewise, holes are not perforated on the first sheet but they are perforated on the second sheet. Thus, as shown in FIG. 6D, sheets on which the milling process has been applied as well as sheets on which the milling process has not been applied are piled on top of one another on the spine-closure surface of the sheet bundle, and in this, state, the adhesive is applied to the piled sheets. Note that in this case, the collated and stacked sheets do not need to be differed alternately in the positions of holes, the number of holes, whether perforated or not perforated, but may be differed for each few sheets, for example.

Explanation of Punch Perforating Operation Procedure

Figure 10A:
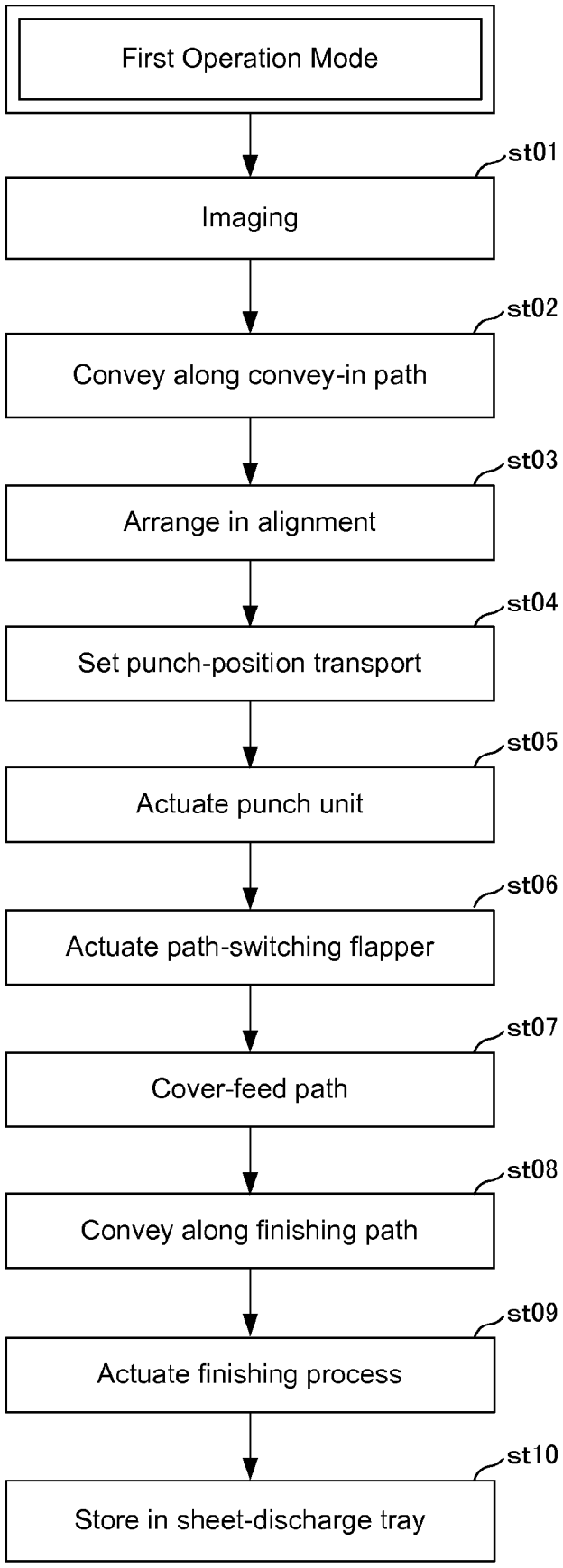
FIG. 10 is an explanatory view showing control flows of a first operation mode and a second operation mode for forming punch holes in the control configuration of FIG. 9.
Figure 10B:
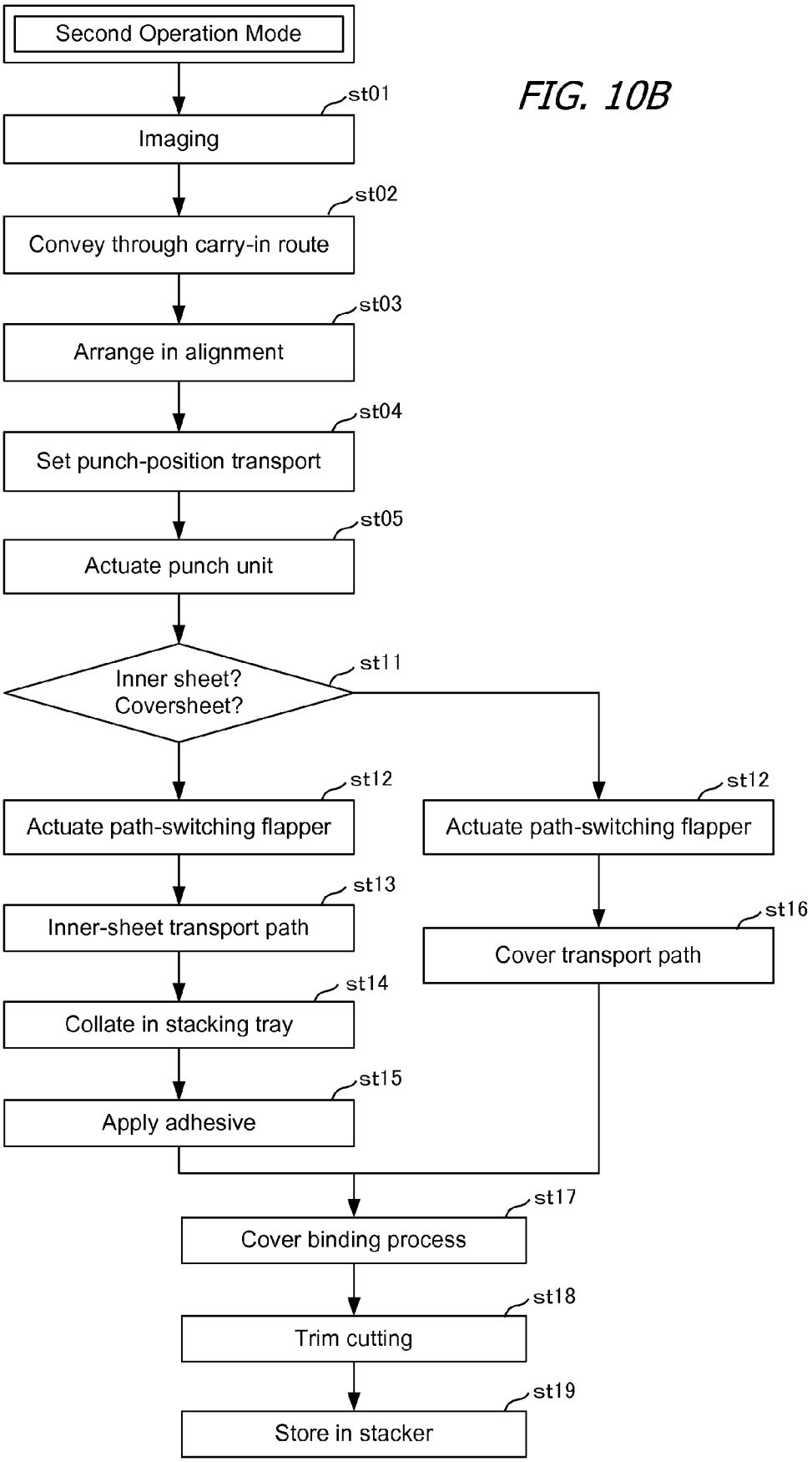

Control of the perforation control means (control CPU 75) will now be explained based on a flowchart shown in FIG. 10. FIG. 10A shows the first operation mode and FIG. 10B shows the second operation mode. In the imaging device A, along with setting the imaging conditions, a punch processing mode (first operation mode) in which the binder holes are formed and a milling processing mode (second operation mode) in which the bookbinding process is performed are selectively set.

When the first operation mode is set, sheets on which images are formed by the imaging device A (St01) are conveyed out to the carry-in path 31. The perforation control means 78 positions the rear end of the sheets by the aligning mechanism 35 (St03). In this positioning, the forward and reverse rotating roller 35*r* is rotated in a direction opposite to the transport direction so as to push the sheets against the regulating means (nipping claws) 35*a*, whereby the sheets are aligned. After the rear end position is aligned, the perforation control means 78 rotates the forward and reverse rotating roller 35*r* in the transport direction for a predetermined amount, and moves the rear end of the sheet from the regulated position Pa to the perforated position Pb. In this way, the rear end of the sheet is set and positioned to the perforated position Pb (St04). Next, the perforation control means 78 rotates and drives the punch driving motor Mp of the punch unit to perforate the binder holes. In the 2-hole perforation mode, the driving axis 86 shown in FIG. 5 is rotated counter-clockwise, and in the 4-hole perforation mode, the driving axis 86 is rotated clockwise (St05).

Next, the control CPU 75 activates the path switching flapper 36 (St06) to move the sheets to the cover-transport path 34 (St07). The finishing path 38 and the paper-discharge tray 37 of the finisher C are disposed at a downstream side of the cover-transport path 34. The control CPU 75 feeds the sheets from the cover-transport path 34 to the finishing path 38 (St08). After that, in the finishing path 38, the finish process is applied such as seals or stamps are applied, the sheets are bound by staple, etc. (St09). Thereafter, the sheets are stored in the paper-discharge tray 37.

On the other hand, when the second operation mode is set, the sheets on which images are formed (St01) by the imaging device A are conveyed out to the carry-in path 31, as shown in FIG. 10B. The perforation control means 78 positions the rear end of the sheets by the aligning mechanism 35 (St03). In this positioning, the forward and reverse rotating roller 35*r* is rotated in a direction opposite to the transport direction so as to push the sheets against the regulating means (nipping claws) 35*a*, whereby the sheets are aligned. After the rear end position is aligned, the perforation control means 78 rotates the forward and reverse rotating roller 35*r* in the transport direction for a predetermined amount, and moves the rear end of the sheets from the regulated position Pa to the perforated position Pb. In this way, the rear end of the sheets is set and positioned to the perforated position Pb (St04). Setting of the sheet to the punching position at this time is executed according to the milling methods (first or fourth methods) described above. Next, the perforation control means 78 rotates and drives the punch driving motor Mp of the punch unit to perforate the milling holes. At this time, the driving axis 86 shown in FIG. 5 is rotated clockwise to provide the 4-hole perforation (St05).

Figure 7A:
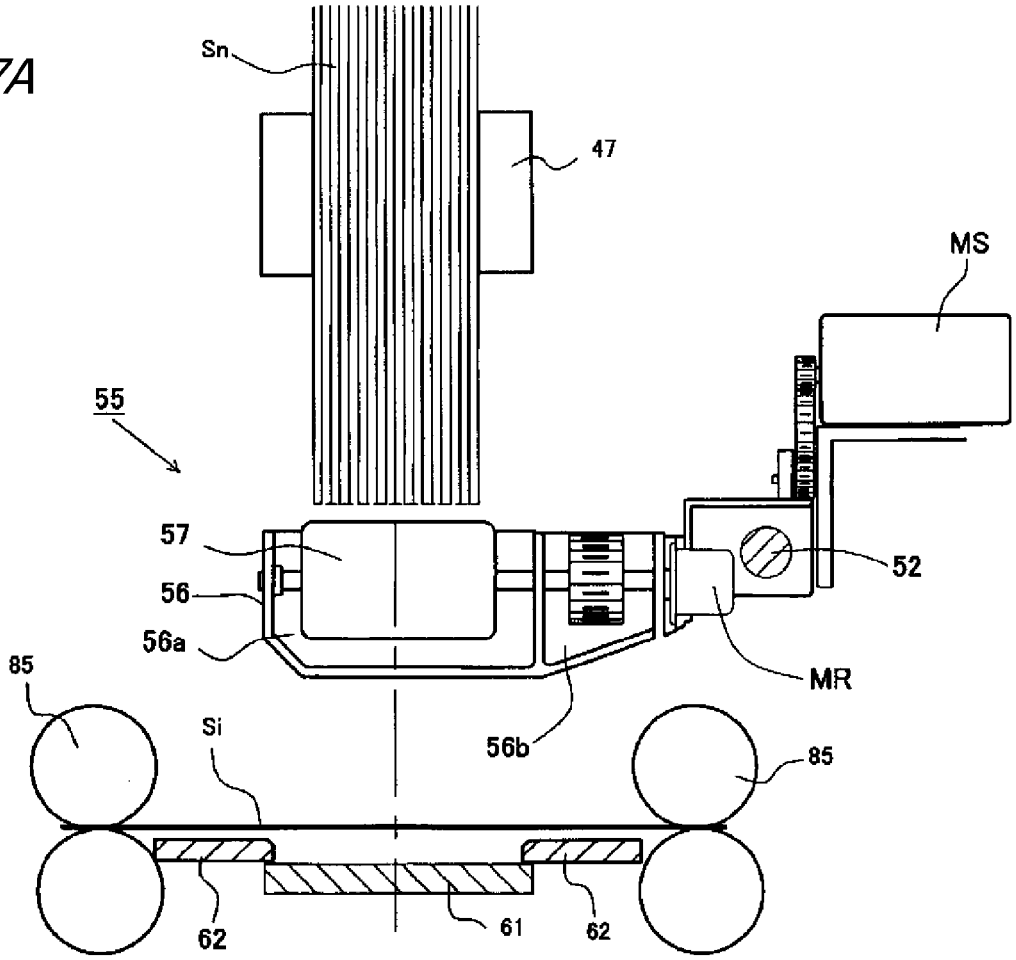
FIG. 7A shows a state of applying adhesive to a collated and stacked sheet bundle.
Figure 7B:
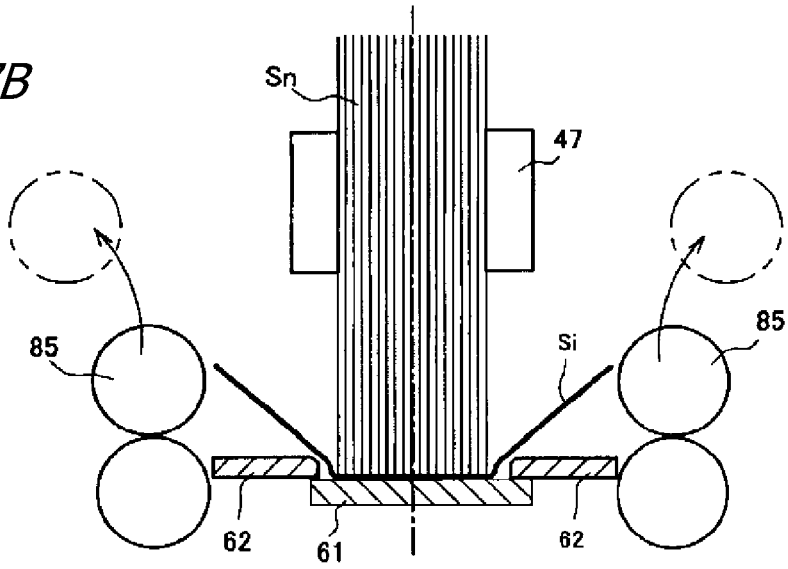
FIG. 7B shows a state that a spine coversheet is fed and set to a processing stage.
Figure 8A:
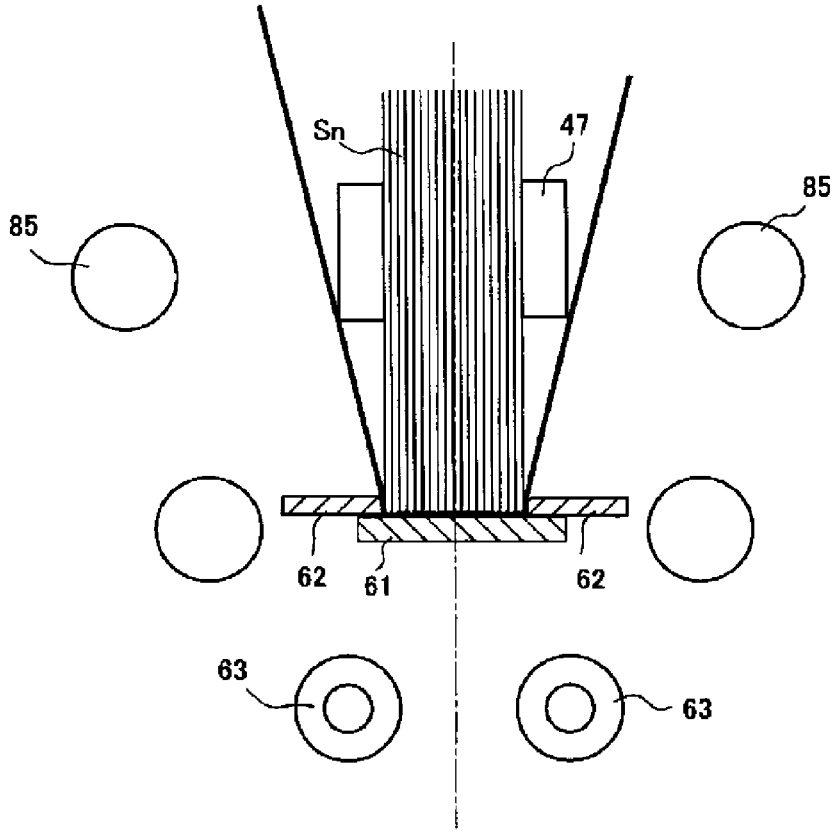
FIG. 8A shows a state that an inner leaf bundle and a spine coversheet are bonded.
Figure 8B:
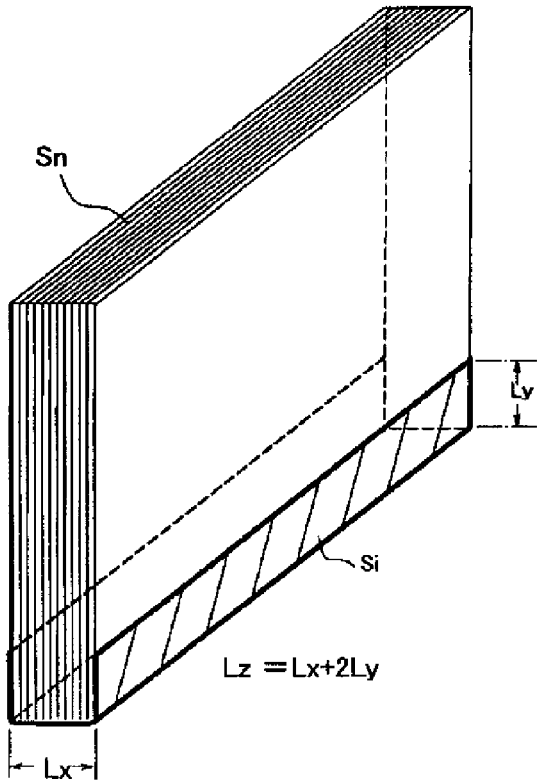
FIG. 8B shows a bookbinding-finished state.

Next, the control CPU 75 determines whether the sheets conveyed to the carry-in path 31 are the inner leaves or the coversheet (St11). When the sheets are inner leaves, the path switching flapper 36 is actuated (St12) to move the sheets to the inner-leaf transport path 32 (St13). The sheets are then collated in a bundle in the stacking tray 41 (St14), and transported in a bundle to the adhesive applying position E. Thereafter, as shown in FIG. 7A, the adhesive is applied to the sheet bundle (St15). On the other hand, when it is determined that the sheet is the coversheet at the step 11, the path switching flapper 36 is actuated to transport the sheets to the cover feed path 34, and set to the cover binding position. As shown in FIG. 7B and FIG. 8A, the book is made (St017) by wrapping the inner leaves (to which the adhesive has been applied) with the coversheet at the cover binding position F so that a book is made. After that, the control CPU 75 moves the sheet bundle in which the cover is bound to the trimming position at a downstream side of the cover binding position, and three directions of the sheet bundle are trimmed by a trimming blade (St18). The sheet bundle in a booklet that undergoes the bookbinding process (shown in FIG. 8B) is stored in the stacker 37 (St19).

Figure 11:
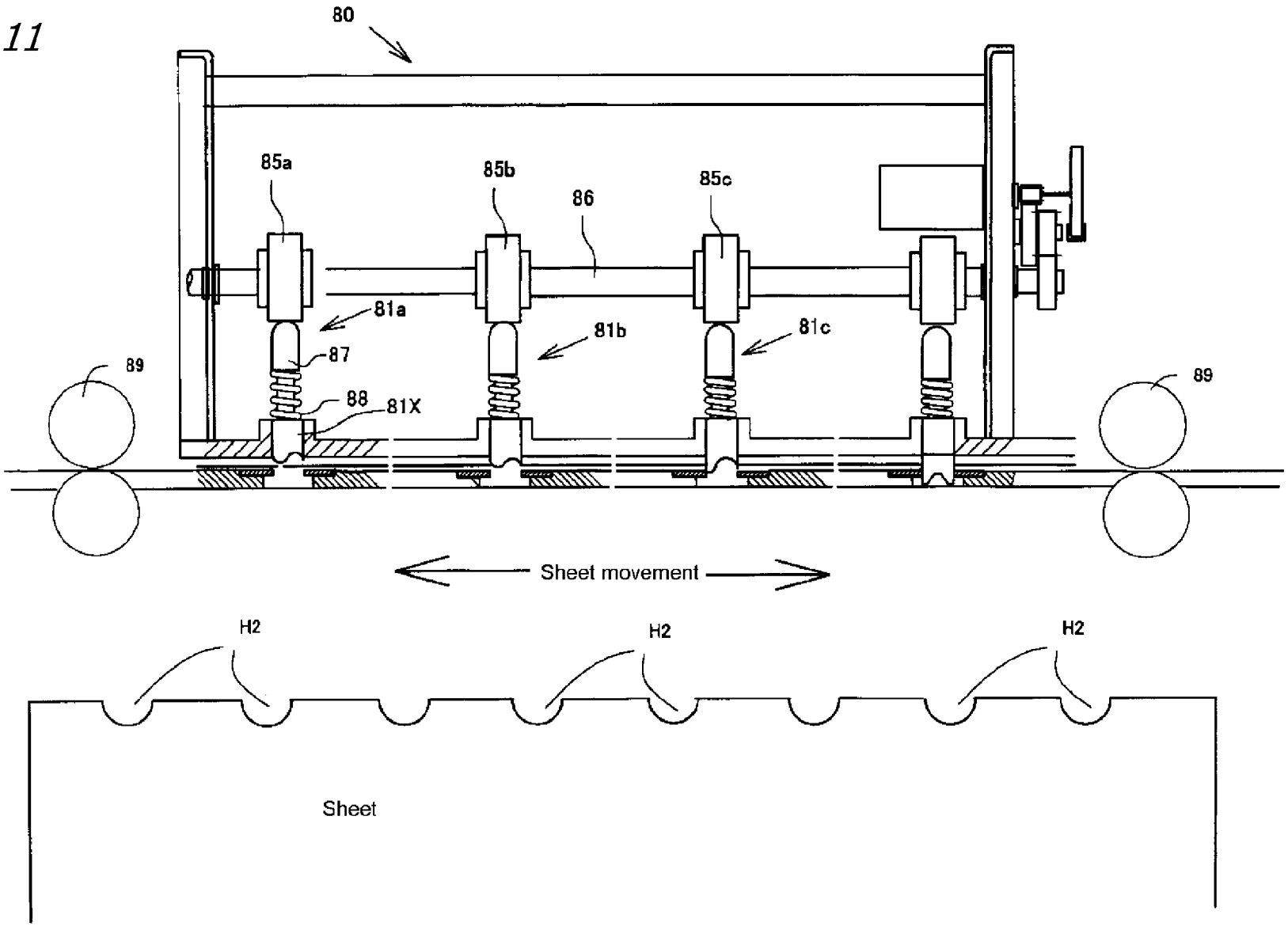
FIG. 11 is an explanatory view showing a manner of a punch unit different from that in the bookbinder of FIG. 4.

In the present invention, it has been depicted that in the punch unit 80, the four punch members 81 are disposed for perforating four holes. However, the punch members may also be disposed for perforating four holes or more. As shown in FIG. 11, when the punch member 81 and the sheet are moved relative to a sheet-width direction, a large number of notch holes can be perforated by using a lesser number of punch members.

The device in FIG. 11 will now be described. The configuration of the punch unit is the same as that in the device in FIG. 5, and thus, like reference numerals are allotted to like parts to omit the duplicated description. In the punch unit 80 shown in FIG. 11, a pair of transport rollers 89 that move the sheet in the width direction are disposed in the left and right, and driving motors not shown are linked to these rollers. The perforation control means 78 perforates 4-hole uneven holes, for example, on one end side in the width direction of the sheet, and then rotate the roller 89 by a predetermined amount to shift the sheet in the width direction. After this sheet is shifted in the width direction, the punch driving motor Mp is again rotated and driven to perforate the other end side of the sheet. As a result, a plurality of crenellated notch-holes H2 is formed as shown in FIG. 11B.

Figure 12:
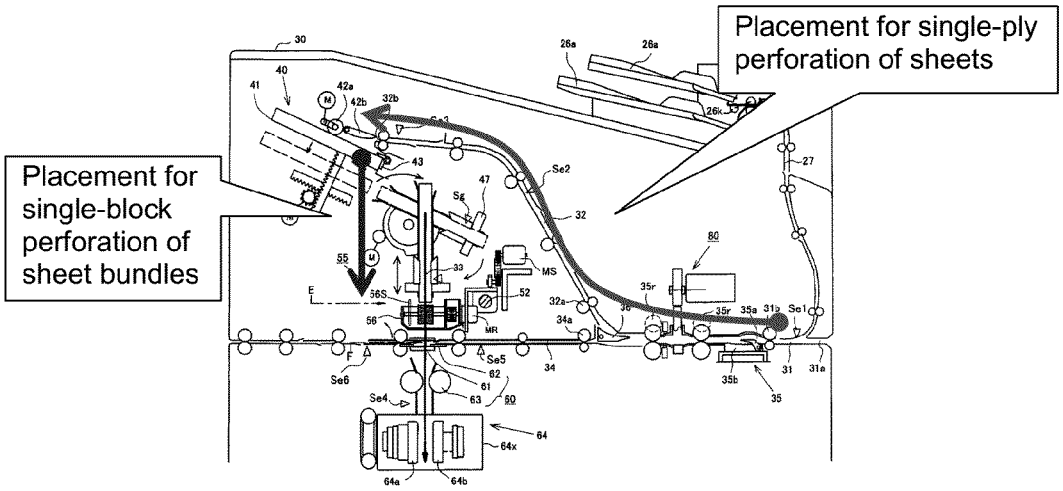
FIG. 12 is a modified version of FIG. 2, indicating alternative locations for a perforating means of the present invention—either along the convey-in path, in an interval between the convey-in path and the stacking means, or in an interval between the stacking means and the adhesive-layer forming means.

In the present invention, the perforating means for perforating the binder holes or the notch holes in the sheet is described. In this case, indicated generally in the right portion of FIG. 12, the perforation is done one sheet by one sheet that has been conveyed to the sheet carry-in path. Alternatively, a perforating means, according to the present invention, for perforating binder holes or notch holes may also be utilized, as indicated generally in the left portion of FIG. 12, on sheet bundles into which sheets have been collated in a bundle. For a device configuration (perforating means) for perforating the sheet bundle, that which is disclosed in Japanese Unexamined Pat. App. Pub. No. 2002-326196 is known, for example.

This application claims priority rights from Japanese Pat. App. No. 2007-314808, which is herein incorporated by reference.

What is claimed is:

1. A bookbinding device, comprising:

a convey-in path for sequentially conveying sheets into the device;

stacking means for collating into bundles sheets conveyed to said stacking means from said convey-in path;

adhesive-layer forming means for adding an adhesive layer to a spine-closure endface of sheet bundles from said stacking means;

cover binding means for binding sheet bundles, from said adhesive-layer forming means, together with cover-sheets;

a cover feed path for feeding coversheets to said cover binding means, said cover feed path connected to, branching from, said convey-in path;

an inner-leaf transport path for transferring sheets to said stacking means, said inner-leaf transport path connected to, branching from, said convey-in path;

a storage stacker disposed along the downstream end of said cover feed path, for stacking and storing sheets;

perforating cutters disposed along said convey-in path, each said perforating cutter comprising a single cutting die and being configured both to form perforating punch-holes and to form crenellating notches in one or a plurality of locations in sheets conveyed along said convey-in path;

positioning means disposed along said convey-in path for setting sheets into a predetermined perforating position; and control means configured for controlling said positioning means thereby controlling the position and/or number of perforations made by said perforating cutters, said control means being configured to operate in a first operation mode in which said control means controls said perforating cutters to perforate thereby forming binder punch-holes through a side-portion of sheets supplied to said convey-in path, and in which said control means causes the binder-hole punched sheets to be transferred along said cover feed path to said storage stacker, and said control means being further configured to operate in a second operation mode in which said control means controls the same said perforating cutters to form crenellating notches in a side-edge of sheets so as to mill the side-edge, and in which said control means causes the side-edge milled sheets to be transferred to said inner-leaf transport path; wherein the bookbinding device is configured so that the transport-direction positions of said perforating cutters and of sheets fed to a perforating position in said convey-in path are shiftable relative to each other; and said control means is further configured so as, in said second operation mode, to vary the relative positions of said perforating cutters and sheets in the perforating position, and thereby adjust the size of the notch holes with which the side-edge of sheets are perforated.

2. The bookbinding device according to claim 1, wherein said control means is configured so as, when sheets are to be transferred from said convey-in path to said stacking means, to cause sheets to be punch-processed in the second operation mode to be fed selectively from sheets not to be punch-processed.

3. The bookbinding device according to claim 1, wherein:

said positioning means is composed of regulating means for regulating sheets by abutting against an edge thereof, and roller means for transporting sheets from said regulating means by a predetermined length; and said control means in the second operation mode adjusts the size of the notch holes with which the side-edge of sheets are perforated according to the length to which the sheets are transported from said regulating means by said roller means.

4. The bookbinding device according to claim 1, further comprising a sheet-type information provision means, wherein:

the perforating cutters include a plurality of perforating cutters for simultaneously perforating sheets widthwise with a plurality of punch holes, and a drive means for driving the plurality of perforating cutters, the plurality of perforating cutters being configured to enable, according to control of said drive means by said control means, selecting the number of punch holes; and said control means is further configured such as to execute said second operation mode based on sheet-type information, including at least one selected from sheet material, sheet size, sheet basis weight, and per-bundle count of sheets collated, from said sheet-type provision means, said control means being configured to determine, based on the sheet-type information, the number of crenellating notches said control means controls said perforating cutters to perforate the side-edge of sheets with.

5. The bookbinding device according to claim 1, wherein said control means is configured so as, in said second operation mode, selectively to cause sheets transferred to said inner-leaf transport path to be punch-processed with notch holes.

6. The bookbinding device according to claim 1, wherein said control means, in said second operation mode, when sheets transferred to said inner-leaf transport path are to be perforated with notch holes, causes punch processing such that the notch holes bored into at least one set of leadingtrailing successive sheets differ by (1) the number of holes, and/or (2) the size of the holes, and/or (3) hole position.

7. A finishing device, comprising:

a convey-in path for sequentially transferring sheets;

stacking means for collating into bundles sheets conveyed to said stacking means from said convey-in path;

adhesive-layer forming means for adding an adhesive layer to a spine-closure side-edge of sheet bundles from said stacking means;

perforating cutters disposed along said convey-in path, each said perforating cutter comprising a single cutting die and being configured to form circular perforations in one or a plurality of locations in sheets conveyed along said convey-in path, each said perforating cutter being configured both to form perforating punch-holes and to form crenellating notches in sheets conveyed along said convey-in path;

positioning means disposed along said convey-in path for setting sheets into a predetermined perforating position; and control means configured for controlling said positioning means thereby controlling the position and/or number of perforations made by said perforating cutters, said control means being configured to operate in a first operation mode in which said control means controls said perforating cutters to perforate a side-portion of sheets with punch holes for a binder, and said control means being further configured to operate in a second operation mode in which said control means controls the same said perforating cutters to crenellate a side-edge of sheets with notches, so as to mill the side-edge; wherein the finishing device is configured so that the transport-direction positions of said perforating cutters and of sheets fed to a perforating position in said convey-in path are shiftable relative to each other; and said control means is further configured so as, in said second operation mode, to vary the relative positions of said perforating cutters and sheets in the perforating position, and thereby adjust the size of the notch holes with which the side-edge of sheets are perforated.

8. The finishing device according to claim 7, wherein:

said perforating cutters are disposed in said convey-in path;

a bookbinding process path and a sheet-discharge process path are installed consecutive with, branching from, said convey-in path;

said stacking means is disposed along the downstream end of said bookbinding process path, and a storage stacker for stacking and storing sheets is disposed along the downstream end of said sheet-discharge process path; and said control means is configured so as when in said first operation mode, to cause perforated sheets to be transferred to said sheet-discharge process path, and when in said second operation mode, to cause perforated sheets to be transferred to said bookbinding process path.

9. A finishing device, comprising:

a convey-in path for transferring bundled sheets;

adhesive-layer forming means for adding an adhesive layer to a spine-closure side-edge of sheet bundles from said convey-in path;

perforating cutters disposed in the convey-in path, each said perforating cutter comprising a single cutting die and being configured to form circular punch-holes in one or a plurality of locations on bundled sheets, each said perforating cutter being configured both to form perforating punch-holes and to form crenellating notches in sheets conveyed along said convey-in path;

positioning means disposed along said convey-in path for setting sheets into a predetermined perforating position; and control means configured for controlling said positioning means thereby controlling the position and/or number of perforations made by said perforating cutters, said control means being configured to operate in a first operation mode in which said control means controls said perforating cutters to perforate a side-portion of sheets with punch holes for a binder, and said control means being further configured to operate in a second operation mode in which said control means controls the same said perforating cutters to crenellate a side-edge of sheets with notches so as to mill the side-edge; wherein the finishing device is configured so that the transport-direction positions of said perforating cutters and of sheets fed to a perforating position in said convey-in path are shiftable relative to each other; and said control means is further configured so as, in said second operation mode, to vary the relative positions of said perforating cutters and sheets in the perforating position, and thereby adjust the size of the notch holes with which the side-edge of sheets are perforated.

10. An imaging system comprising:

an imaging device for sequentially forming images on sheets; and a bookbinding device for collating sheets from the imaging device into bundles and encasing the bundles in cover-sheets to form booklets; wherein said bookbinding device is furnished with the configuration set forth in claim 1.

11. An imaging system comprising:

an imaging device for sequentially forming images on sheets; and a bookbinding device for collating sheets from the imaging device into bundles and encasing the bundles in cover-sheets to form booklets; wherein said bookbinding device is furnished with the configuration set forth in claim 2.

12. An imaging system comprising:

an imaging device for sequentially forming images on sheets; and a bookbinding device for collating sheets from the imaging device into bundles and encasing the bundles in cover-sheets to form booklets; wherein said bookbinding device is furnished with the configuration set forth in claim 3.

13. An imaging system comprising:

an imaging device for sequentially forming images on sheets; and a bookbinding device for collating sheets from the imaging device into bundles and encasing the bundles in cover-sheets to form booklets; wherein said bookbinding device is furnished with the configuration set forth in claim 4.

14. An imaging system comprising:

an imaging device for sequentially forming images on sheets; and a bookbinding device for collating sheets from the imaging device into bundles and encasing the bundles in cover-sheets to form booklets; wherein said bookbinding device is furnished with the configuration set forth in claim 5.

15. An imaging system comprising:

an imaging device for sequentially forming images on sheets; and a bookbinding device for collating sheets from the imaging device into bundles and encasing the bundles in cover-sheets to form booklets; wherein said bookbinding device is furnished with the configuration set forth in claim 6.

16. The bookbinding device according to claim 1, wherein:

said perforating cutters are arranged widthwise-paralleling sheets conveyed along said convey-in path, and comprise a plurality of perforating cutters for perforating the conveyed sheets widthwise with a plurality of punch holes;

the bookbinding device is configured so that the transport-direction positions of said perforating cutters and of sheets fed to a perforating position in said convey-in path are shiftable relative to each other; and said control means is configured so as, in said first operation mode and in said second operation mode, to vary the relative positions of said perforating cutters and sheets in the perforating position, and therein to control said perforating cutters such that in said first operation mode, said perforating cutters punch sheets inward of their side-edge with binder punch holes, and in said second operation mode, said perforating cutters perforate the side-edge of sheets with crenellating notches so as to mill the side-edge.

17. The bookbinding device according to claim 16, wherein:

positioning means for setting sheets into a predetermined perforating position is provided in said convey-in path, said positioning means being composed of regulating means for regulating sheets by abutting against an edge thereof, and roller means for transporting sheets from said regulating means by a predetermined length; and said control means in said first operation mode and in said second operation mode varies the predetermined length by which sheets are transported from said regulating means by said roller means.

18. The bookbinding device according to claim 1, being configured so that said perforating cutters, and sheets fed to a perforating position in said convey-in path are shiftable relative to each other widthwise of sheets conveyed along said convey-in path.

* * * * *